US008240112B2

(12) United States Patent
Binger et al.

(10) Patent No.: US 8,240,112 B2
(45) Date of Patent: Aug. 14, 2012

(54) EVACUATION DEVICE

(75) Inventors: Scott Binger, Bridgeview, IL (US); Andrew E. Neltner, Cincinnati, OH (US)

(73) Assignee: The Glad Products Company, Oakland, CA (US)

( * ) Notice: Subject to any disclaimer, the term of this patent is extended or adjusted under 35 U.S.C. 154(b) by 953 days.

(21) Appl. No.: 12/298,728

(22) PCT Filed: Apr. 11, 2007

(86) PCT No.: PCT/US2007/066384

§ 371 (c)(1),
(2), (4) Date: Oct. 27, 2008

(87) PCT Pub. No.: WO2007/143273

PCT Pub. Date: Dec. 13, 2007

(65) Prior Publication Data

US 2009/0199724 A1 Aug. 13, 2009

(51) Int. Cl.
*B65B 31/04* (2006.01)

(52) U.S. Cl. ..... 53/434; 99/467; 99/472; 99/476; 53/405; 53/432; 53/510; 53/511; 53/512; 417/415

(58) Field of Classification Search ..... 99/467, 99/472, 476; 53/405, 432, 434, 510–512; 417/415

See application file for complete search history.

(56) References Cited

U.S. PATENT DOCUMENTS 4,367,565 A * 1/1983 Parise ..... 15/321
4,745,730 A * 5/1988 Bartle, Sr. ..... 53/405
4,984,611 A * 1/1991 Takatsuki et al. ..... 141/65
5,031,785 A * 7/1991 Lemme ..... 215/228
5,121,590 A * 6/1992 Scanlan ..... 53/510
5,195,427 A * 3/1993 Germano ..... 99/472
5,215,445 A * 6/1993 Chen ..... 417/313
5,338,166 A * 8/1994 Schultz ..... 417/442
5,513,480 A * 5/1996 Tsoi ..... 53/510
5,540,557 A * 7/1996 Carson ..... 417/53
5,765,608 A * 6/1998 Kristen ..... 141/198
5,784,862 A * 7/1998 Germano ..... 53/512
5,833,287 A * 11/1998 Shade ..... 406/171
6,319,410 B1 * 11/2001 Allington et al. ..... 210/634
6,520,071 B1 * 2/2003 Lanza ..... 99/472
6,598,626 B2 * 7/2003 Chaffee ..... 141/65
6,626,092 B2 * 9/2003 Tarlow ..... 99/472
6,644,489 B2 * 11/2003 Chang ..... 220/203.01
6,834,636 B2 * 12/2004 Thomas et al. ..... 123/241
6,971,417 B2 * 12/2005 Deni ..... 141/65

(Continued)

*Primary Examiner* — Gene Kim
*Assistant Examiner* — Alexander Niconovich
(74) *Attorney, Agent, or Firm* — David Peterson

(57) ABSTRACT

The evacuation device is configured to remove air from a container via a one-way valve element attached to the container. The evacuation device includes a motor with a rotating shaft that extends along an axis line. The shaft is operably interconnected to a reciprocating element reciprocally movable within a chamber along a direction parallel to the axis line. Reciprocal motion of the reciprocal element draws air into and exhausts air from the chamber. To facilitate the operable interconnection, the evacuation device includes a cam having a cylindrical sidewall mounted to the rotating shaft. Disposed circumferentially into the cylindrical sidewall is a channel. The evacuation device further includes a yoke connected to the reciprocal element and having a follower element received in the channel. Rotation of the cam causes the follower element to move with respect to the channel, thereby converting rotational motion to linear translation. The evacuation device may also include a pressure adjustment feature. In one embodiment, the pressure adjustment feature may include a rotating ring with a series of holes.

14 Claims, 19 Drawing Sheets

U.S. PATENT DOCUMENTS 7,021,034 B2 * 4/2006 Higer et al. ..... 53/512
7,063,520 B2 * 6/2006 Oh et al. ..... 417/547
7,318,539 B2 * 1/2008 Vitantonio et al. ..... 222/333
7,389,629 B2 * 6/2008 Tretina ..... 53/512
7,524,652 B2 * 4/2009 Ammann et al. ..... 435/91.2
7,870,708 B2 * 1/2011 Borchardt et al. ..... 53/510
7,937,914 B2 * 5/2011 Savicki et al. ..... 53/510
8,096,329 B2 * 1/2012 Thuot et al. ..... 141/65
2004/0211792 A1 * 10/2004 Vitantonio et al. ..... 222/333
2005/0039421 A1 * 2/2005 Cheung ..... 53/510
2005/0061813 A1 * 3/2005 Vilalta et al. ..... 220/212
2005/0074342 A1 * 4/2005 Lemme et al. ..... 417/415
2005/0132706 A1 * 6/2005 Fukutani et al. ..... 60/726
2006/0003373 A1 * 1/2006 Ammann et al. ..... 435/6
2009/0229225 A1 * 9/2009 Borchardt et al. ..... 53/434

* cited by examiner

FIG. 11
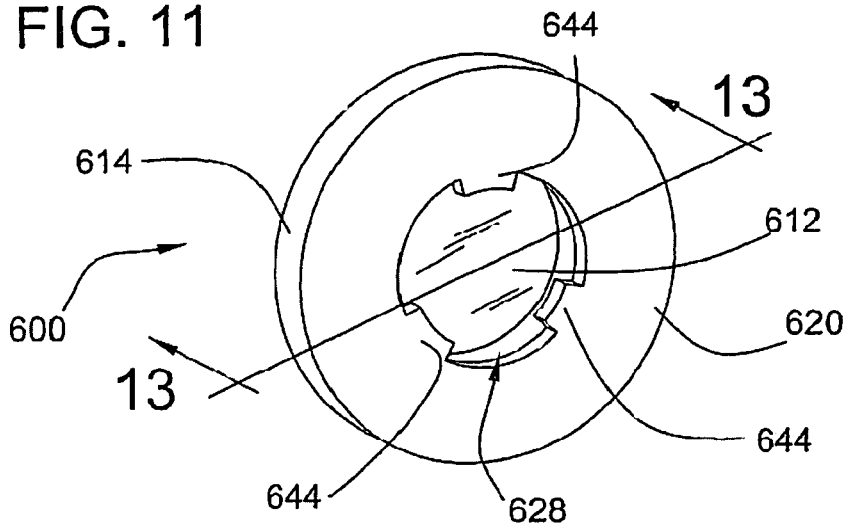
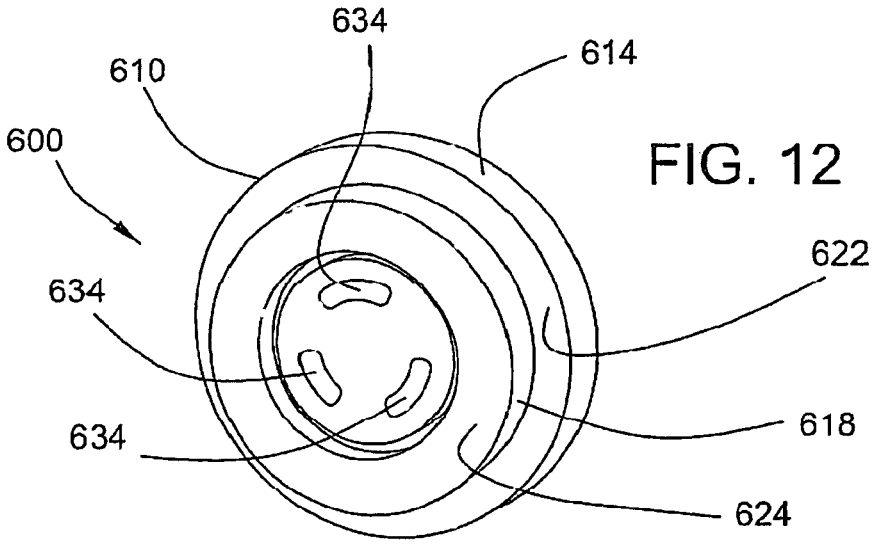
FIG. 12
FIG. 13
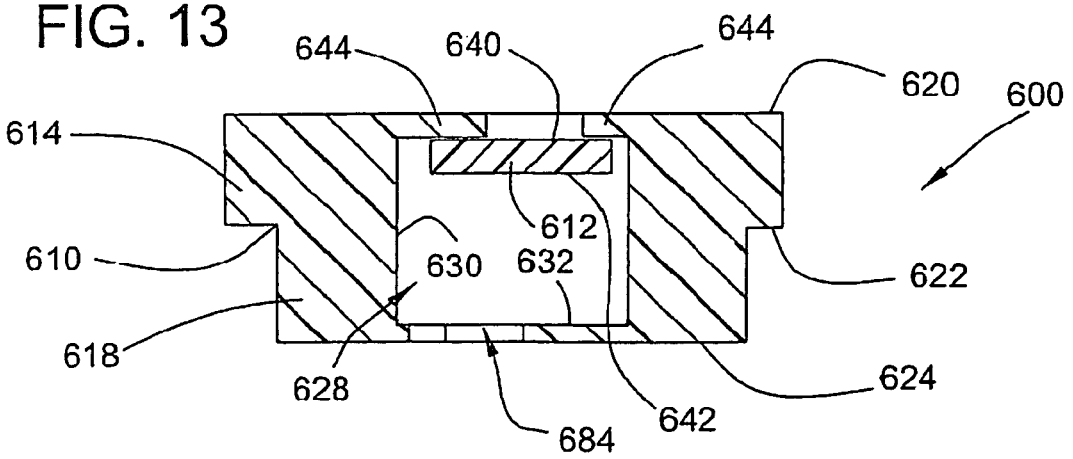

EVACUATION DEVICE

FIELD OF INVENTION

The invention pertains generally to air moving devices and methods and more particularly to evacuation devices and methods for removing air from containers. The invention finds particular applicability in the field of food preservation.

BACKGROUND

It is known that storing food items in an environment evacuated of air will help preserve and prolong the freshness of those items. To accomplish this, the food items may be placed in an internal volume of a rigid container which is then sealed and air trapped in the internal volume is removed. To enable evacuation of the internal volume, the container may include a one-way valve element communicating with the internal volume. The one-way valve element allows for the evacuation of trapped air while preventing the ingress of the surrounding environmental air into the interior volume thereby preserving the evacuated state.

A variety of different evacuation devices have been employed for actually evacuating air through the one-way valve element. Examples of such evacuation devices include hand operated pumps in which continuous hand manipulation is required to provide the pumping action. Other evacuation devices may be electrically activated and may be configured as either counter-top designs or as hand-held designs. Desirably, such electrical evacuation devices should operate smoothly and quietly and, when configured as hand-held devices, should be sufficiently lightweight and compact.

SUMMARY OF THE INVENTION

The invention provides an evacuation device for evacuating air from the internal volume of a container via a one-way valve element. The evacuation device includes an electrical motor having a rotating shaft extending from the front face of the motor. The rotating shaft defines an axis line that extends through the evacuation device. The evacuation device also includes a reciprocal member movable in a chamber in a linear direction parallel to or along the axis line. The reciprocal motion of the reciprocal member in the linear direction parallel to or along the axis line provides a pumping action for removing air from a container.

To operatively connect the motor to the reciprocal member such that rotation of the motor shaft can be converted into linear motion of the reciprocal member parallel to the axis line, the evacuation device includes a cam and a yoke. The cam is mounted to the shaft and includes a cylindrical sidewall into which is disposed a slot or channel. The channel extends about the circumference of the cylindrical sidewall in a sinusoidal pattern such that the channel alternately moves towards and away from the chamber. The sinusoidal pattern also extends concentrically about the axis line. The yoke at one end is connected to the reciprocal element and at the other end includes at least one follower element that is received into the channel of the cam.

Rotation of the motor shaft therefore rotates the cam with respect to the follower element such that the follower element is forced to move through the rotating sinusoidal pattern provided by the channel. Because the sinusoidal pattern is concentric about the axis line, the forced movement of the follower element is converted to linear reciprocal displacement of the yoke and the connected reciprocal element along the axial direction.

In another aspect of the invention, the evacuation device can be configured with features that provide for adjusting or controlling the vacuum pressure of the device. The adjustment or control features can operate by allowing ambient air to enter the system during evacuation.

An advantage of the invention is that it provides an evacuation device for evacuating air from a container in order to preserve food items. Another advantage is that the evacuation device converts rotational motion of a motor shaft to linear motion of a reciprocal element so as to provide a pumping action. This advantage allows for compact sizing and stable operation of the evacuation device. These and other advantages and features of the invention will become apparent from the detailed description and the accompanying drawings.

BRIEF DESCRIPTION OF THE DRAWINGS

FIG. 11 is a front perspective view of an embodiment of a one-way valve element for use with flexible bags of the invention.

FIG. 12 is a rear perspective view of the one-way valve element of FIG. 11.

FIG. 13 is a cross-sectional view through the one-way valve element, as taken along line 13-13 of FIG. 11.

DETAILED DESCRIPTION OF THE EMBODIMENTS

Figure 1:
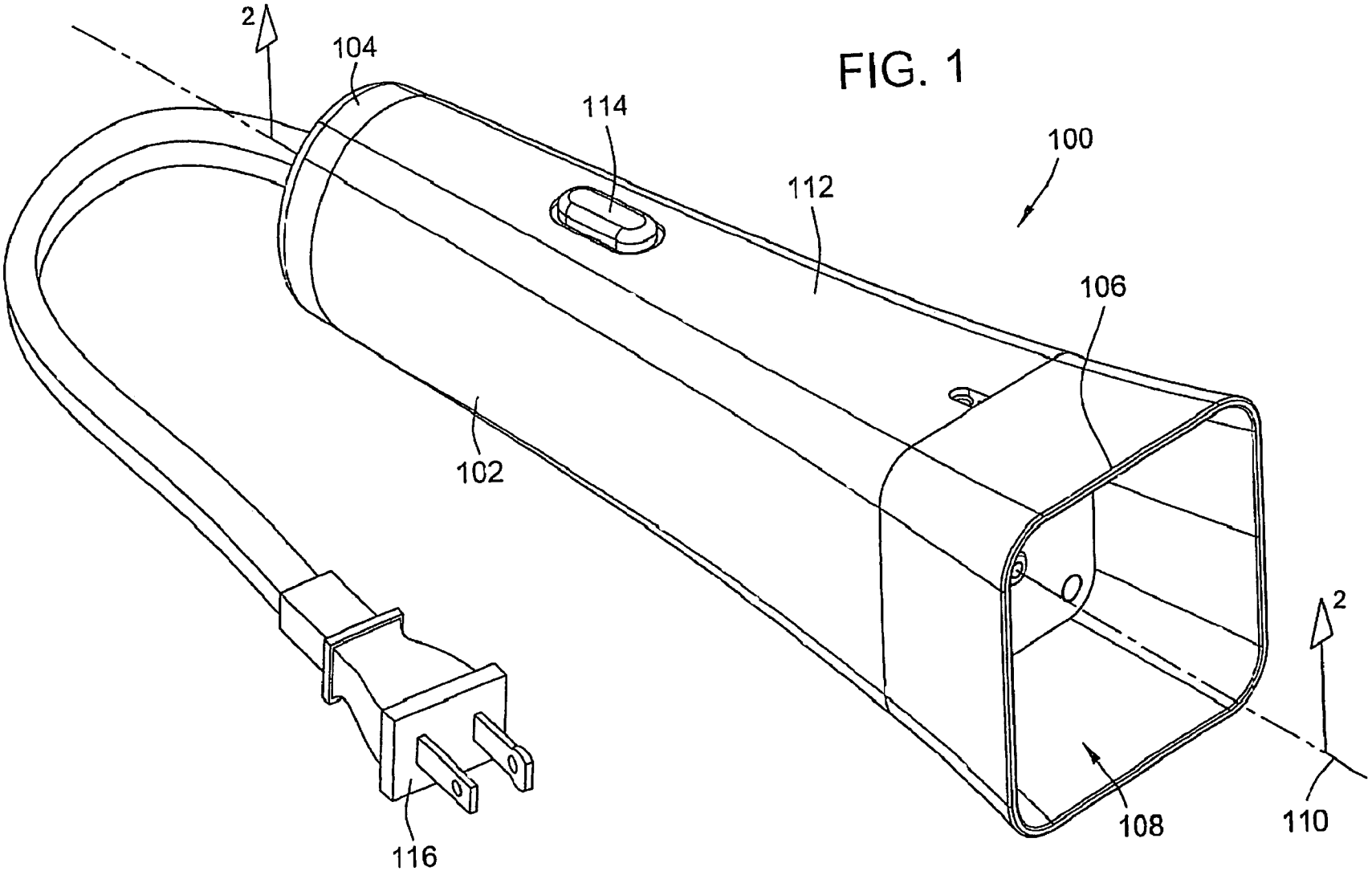
FIG. 1 is a perspective view of an evacuation device for evacuating a container designed in accordance with the teachings of the invention.

Now referring to the drawings, there is illustrated in FIG. 1 an electrically operated evacuation device 100 designed in accordance with the invention. The immediate embodiment of the evacuation device 100 is configured to be hand-held though, in other embodiments of the invention, could be configured as a countertop design. The illustrated evacuation device 100 includes an elongated housing 102 that extends between a rearward circular closed end 104 and a forward skirt-like nozzle end 106 that outlines an intake volume 108. In use, the nozzle end 106 is intended to be placed against or about a one-way valve element attached to a container so the valve element is exposed to the intake volume 108. Preferably, the area of the skirt-like nozzle end 106 is sufficiently large to fit about a variety of different valve elements. In the illustrated embodiment, the nozzle end has a generally square shape in contrast to the circular shape of the rearward closed end. The evacuation device 100 tapers slightly outward between the closed end 104 and the nozzle end 106 so that the main body portion 112 can function as a handle. For purposes of reference, an axis line 110 extends through and aligns the closed end 104, body portion 112, and nozzle end 106. The housing 102 can be made from any suitable material including injection moldable thermoplastic material.

To selectively activate the evacuation device 100, a switch 114 can be disposed along the body portion 112 of the housing 102. Furthermore, to establish electrical communication with an electrical socket, the evacuation device 100 also includes a power cord 116 extending from the closed end 104. However, in other embodiments, instead of communicating with power sockets, the electrical evacuation device 100 can be configured to operate from batteries that are to be placed inside the housing 102.

Figure 2:
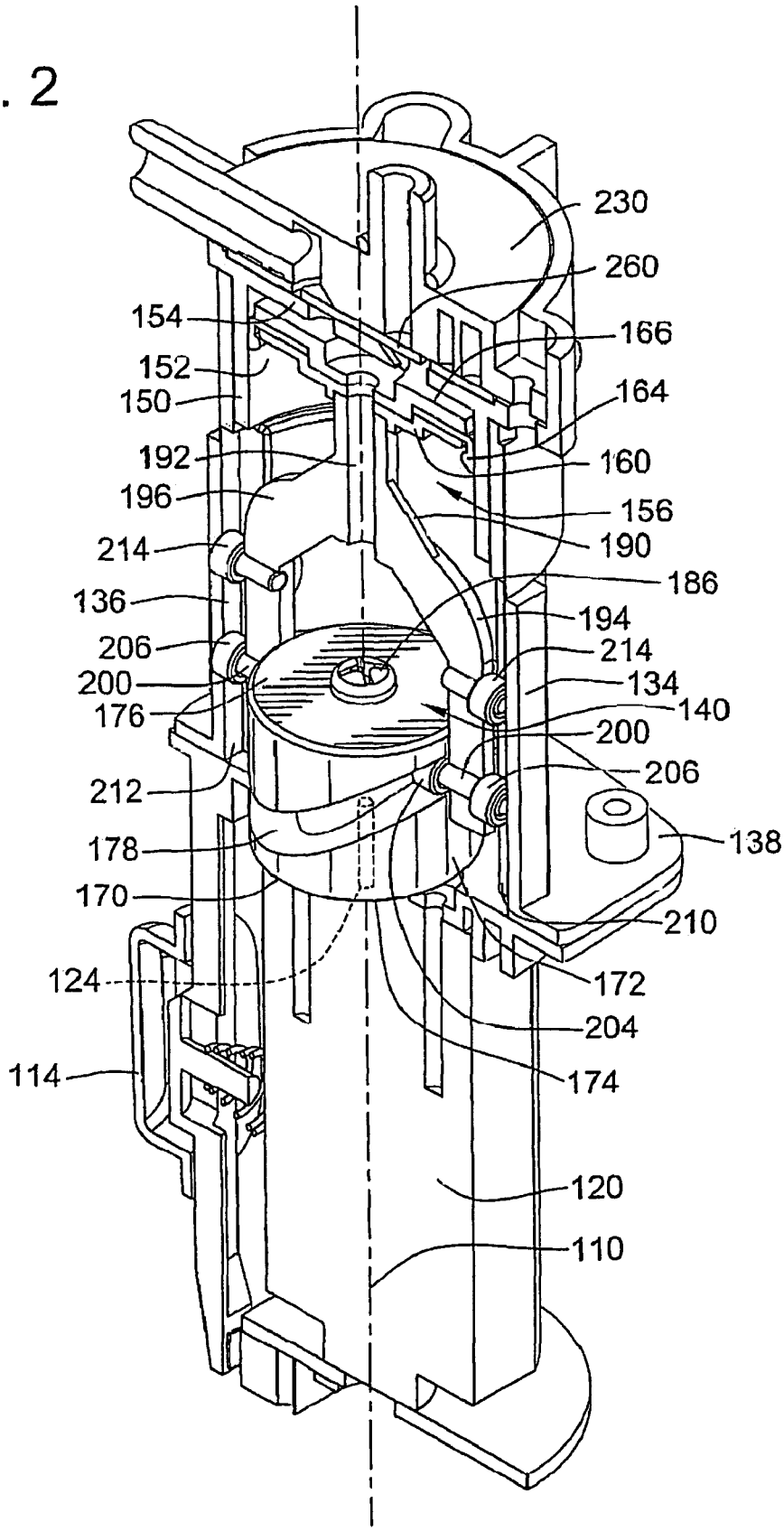
FIG. 2 is a perspective cross-sectional view taken along line 2-2 of FIG. 1 showing the internal components of the evacuation device with the housing removed.
Figure 3:
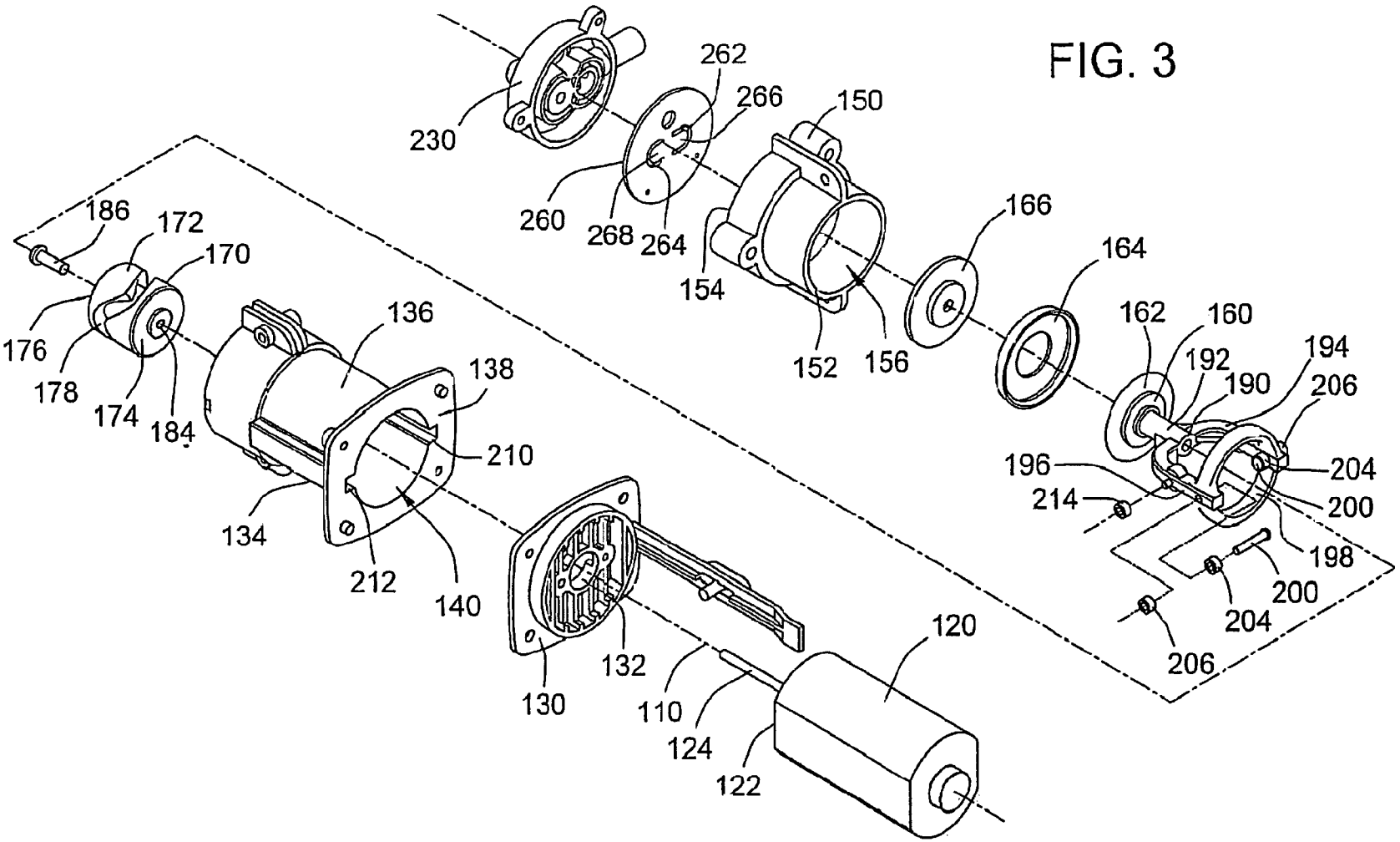
FIG. 3 is an exploded view of the evacuation device illustrating the arrangement of the components.

Referring to FIGS. 2 and 3, the components of the evacuation device 100 that are typically enclosed in the housing include an electrically activated motor 120. The motor can be configured to operate on either AC or DC electricity depending upon the power source that the evacuation device 100 is intended to employ. Extending from a front face 122 and generally concentric with the rest of the motor 120 is a rotatable motor shaft 124. As will be appreciated, activating the motor causes rotation of the shaft 124. Furthermore, the shaft 124 extends along and thereby determines the position of the axis line 110. As illustrated in FIG. 2, the motor 120 can be selectively activated to rotate the shaft 124 by depressing switch 114.

Abutting against the front face 122 of the motor 120 is a motor grill 130 that helps support and locate the motor within the housing. Disposed generally through the center of the motor grill 130 is an aperture 132 through which the motor shaft 124 can pass. Located axially forward of and adjacent to the motor grill 130 is a bore housing 134 that has a generally tubular body 136 extending from a flange 138 positioned to abut the motor grill 130. The tubular body 136 provides a bore 140 that, when the bore housing 134 is assembled with the other components, aligns with and extends along the axis line 110. The motor grill 130 and bore housing 134 can be made from any suitable material including, for example, injection molded thermoplastic.

A chamber body 150 is located axially forward of the bore housing 134. The chamber body 150 can receive a linearly movable reciprocal element 160. The chamber body 150 includes a cylindrical sidewall 152 across the front of which is positioned a forwardly arranged, axial face wall 154. The cylindrical sidewall 152 and axial face wall 154 are thus arranged to provide a cylindrical chamber 156. When adjacent the bore housing 134, the cylindrical sidewall 152 can align with and can extend concentrically about the axis line 110 while the axial face wall can be perpendicular to the axis line.

In the embodiment illustrated in FIGS. 2 and 3, the reciprocal element 160 can be a circular piston 162 that is sized to slidably fit into the chamber 156. To facilitate the slidable fit, the piston 162 can also include a piston ring 164 that is secured thereto by a piston cap 166. The piston ring 164 can be made of a suitable low friction material to both prevent scoring and seizing between the piston 162 and the cylindrical sidewall 152 and to provide a leak-tight seal therebetween. The reciprocal motion of the piston 162 linearly with respect to the chamber 156 provides an alternately expanding and contracting space between the axial face 154 and the piston that can be manipulated to generate alternating suction and exhaustion forces. In other embodiments, the reciprocal element can be a flexible membrane. The periphery of the reciprocal element may be joined to the cylindrical sidewall 152. The flexible membrane can be operatively connected to the motor such that rotation at the motor shaft causes linear reciprocation at the membrane. Similar to the piston, the linear reciprocal motion provides an alternately expanding and contracting space between the axial face of the chamber and the membrane that can be employed to generate alternating suction and exhaustion forces.

To convert the rotational motion of the motor shaft 124 to the linear or translational motion of the reciprocal element 160, the evacuation device 100 further includes a cam 170 and a cooperating yoke 190. Hence, the cam 170 and the yoke 190 operatively interconnect the motor 120 with the reciprocal element 160. When the evacuation device 100 is assembled together, as illustrated in FIG. 2, the cam 170 and yoke 190 are generally located in the bore 140 provided by the bore housing 134.

Figure 4:
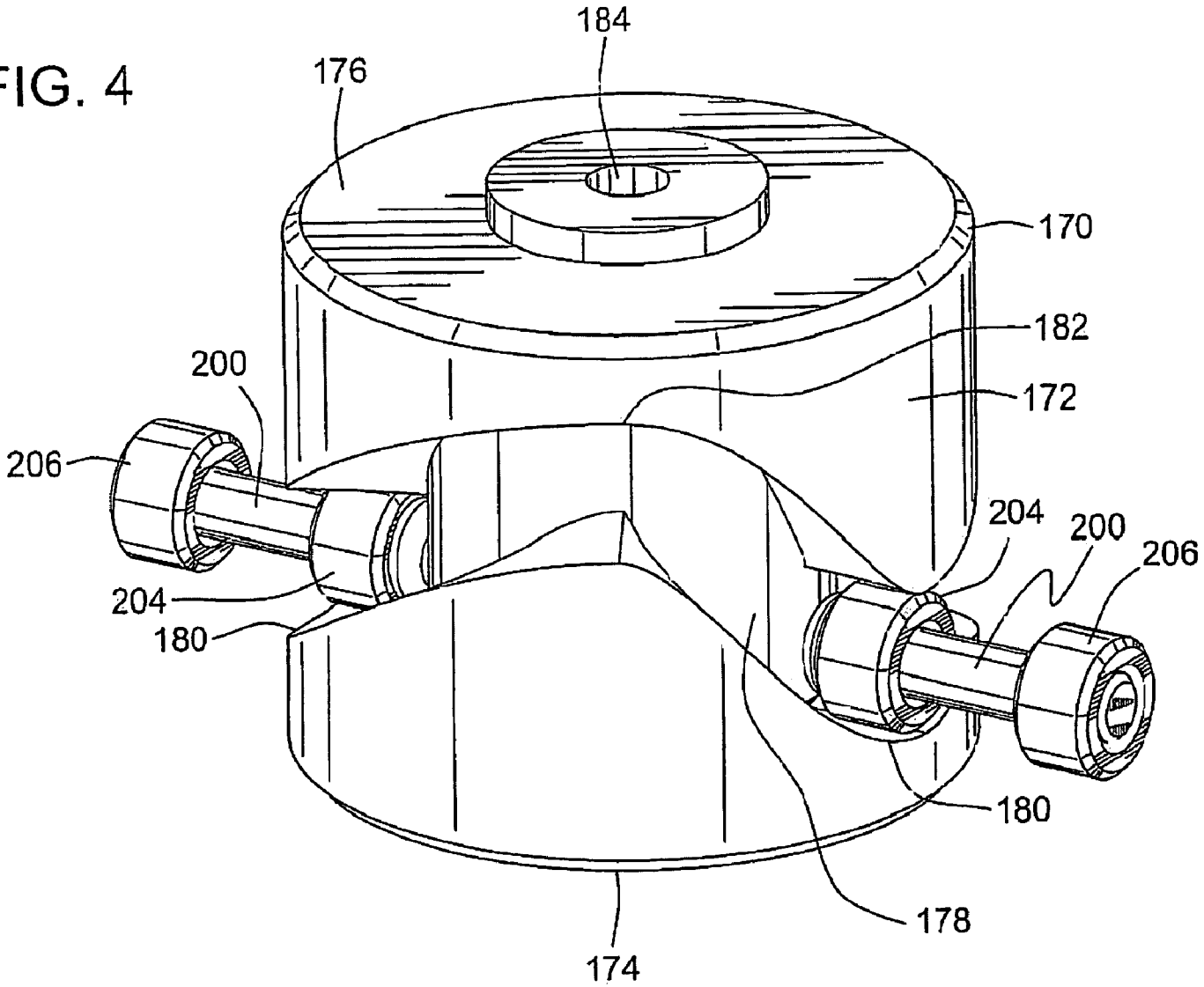
FIG. 4 is a perspective view of a cylindrical cam including a sinusoidal channel adapted to engage the illustrated follower elements for use with the evacuation device.

Referring to FIG. 4, the cam 170 is a cylindrical structure having a cylindrical sidewall 172 that extends between a first end face 174 and a second end face 176. The cam can be a unitary solid product or can be formed by multiple components. Disposed into the cylindrical sidewall 172 continuously about the circumference of the cam 170 is a slot or channel 178. The channel 178 has a sinusoidal pattern so that the channel traverses the cylindrical sidewall 172 between points proximate the first and second end faces 174, 176. In the illustrated embodiment, the sinusoidal pattern repeats itself once such that the channel 178 has two inflexion points 180 proximate the first end face 174 and two inflexion points 182 proximate the second end face 176. In other embodiments, the continuous channel can have any other suitable pattern and can include any number of possible inflexion points.

Disposed between the first and second end faces 174, 176 of the cam 170 is a central bore 184 concentric to the first cylindrical sidewall 172. Referring to FIGS. 2 and 3, the central bore 184 can be mounted onto the motor shaft 124 and fixed to the motor shaft 124 with a fastening element 186 or, in other embodiments, by a press fit relationship. When the cam 170 is mounted to the motor shaft 124, the first end face 174 is directed forwards toward the chamber body 150 and the second end face 176 is directed rearward towards the motor 120. Moreover, due to the concentric relation between the cylindrical sidewall 172 and the central bore 184, the cylindrical sidewall is also concentrically aligned about the axis line 110.

Referring to FIG. 3, the yoke 190 has a wishbone or Y-shape including a main arm 192 and bifurcated first and second arms 194, 196. To support the bifurcated first and second arms 194, 196, the illustrated yoke 190 may also include a circular support member 198 arranged generally perpendicular to the main arm 192 and interconnecting the first and second arms. When assembled with the other components, the forward end of the main arm 192 is connected to the reciprocal element 160 while the first and second arms 194, 196 engage the rearwardly positioned cam 170.

To engage the cam 170, the yoke 190 includes a plurality of follower elements 200 that are attached to the first and second arms 194, 196. Each follower element 200 includes a first inner wheel 204 along the inside of an arm and a second, corresponding, outer wheel 206 along the outside of the arm. The inner and outer wheels 204, 206 may be rotatable with respect to the first and second arms 194, 196. When the yoke 190 is engaged to the cam 170, as illustrated in FIG. 2, the first and second arms 194, 196 extend along either side of the cylindrical sidewall 172 so that the inner wheels 204 of each follower element 200 can be received in the channel 178 as illustrated in FIG. 4. Furthermore, referring back to FIGS. 2 and 3, with the yoke 190 so engaged, the main arm 192 is parallel to and aligned along the axis line 110 extending through the evacuation device 100. In other embodiments, the main arm 192 could extend parallel to but offset from the axis line 110.

To assist in supporting and guiding the yoke 190 within the evacuation device 100, referring to FIGS. 2 and 3, there is disposed in the bore housing 134 along the sides of the bore 140 first and second longitudinal guide slots 210, 212. The first and second slots 210, 212 extend from the flange 138 through the tubular housing 136. When the components are assembled together, the outer wheels 206 of the follower elements 200 can be received in the first and second guide slots 210, 212. Furthermore, the yoke 190 can also include additional rotating guide wheels 214, with one wheel located outside of each of the first and second arms 194, 196. The guide wheels 214 are located forward of the follower elements 200 and can also be received in the first and second guide slots 210, 212.

With reference to FIG. 2, in operation the motor shaft 124 rotates thereby causing rotation of the fixed cam 170. Because the yoke 190 is constrained against rotational motion by the follower elements 200 and guide wheels 214 received in the guide slots 210, 212, the channel 178 disposed in the cam must pass along the follower elements. Due to the sinusoidal pattern of the channel 178, the follower elements 200 will uniformly and repeatedly move between the first and second end faces 174, 176 of the cam 170. The motion of the follower elements 200 between the end faces 174, 176 causes reciprocal back and forth displacement of the yoke 190 and the connected reciprocal member 160 thereby providing the pumping action. The quantity of displacement will be a function of the amplitude of the sinusoidal pattern.

Hence, the cooperation between the cam 170 and the yoke 190 converts rotational motion of the motor 120 to linear or translational motion of the reciprocal element 160. Because this result is achieved with two components, the overall size and length of the evacuation device can be reduced. The two component design also reduces the number of points of efficiency loss that may result from friction thereby allowing a reduction in the motor size.

Additionally, in the embodiment illustrated in FIG. 2, both the axis of rotation of the motor, the axis of rotation of the cooperating cam, and the axis of linear motion of the interconnected yoke and reciprocal element may all be coaxial along the axis line 110. Receiving the guide wheels 214 in the guide slots 210, 212 prevents the yoke 190 from pivoting about the follower elements 200 with respect to the axis line 110, helping to ensure that the yoke remains aligned with the axis line. Aligning the axis of motion of the various elements in the foregoing manner helps reduce vibration of the evacuation device and any accompanying noise. Of course, in other embodiments, it will be appreciated that linear motion of the reciprocal element and the yoke can be parallel to but not precisely coaxial with the axis of rotation of the motor while still achieving many of the advantages of the invention.

Figure 5:
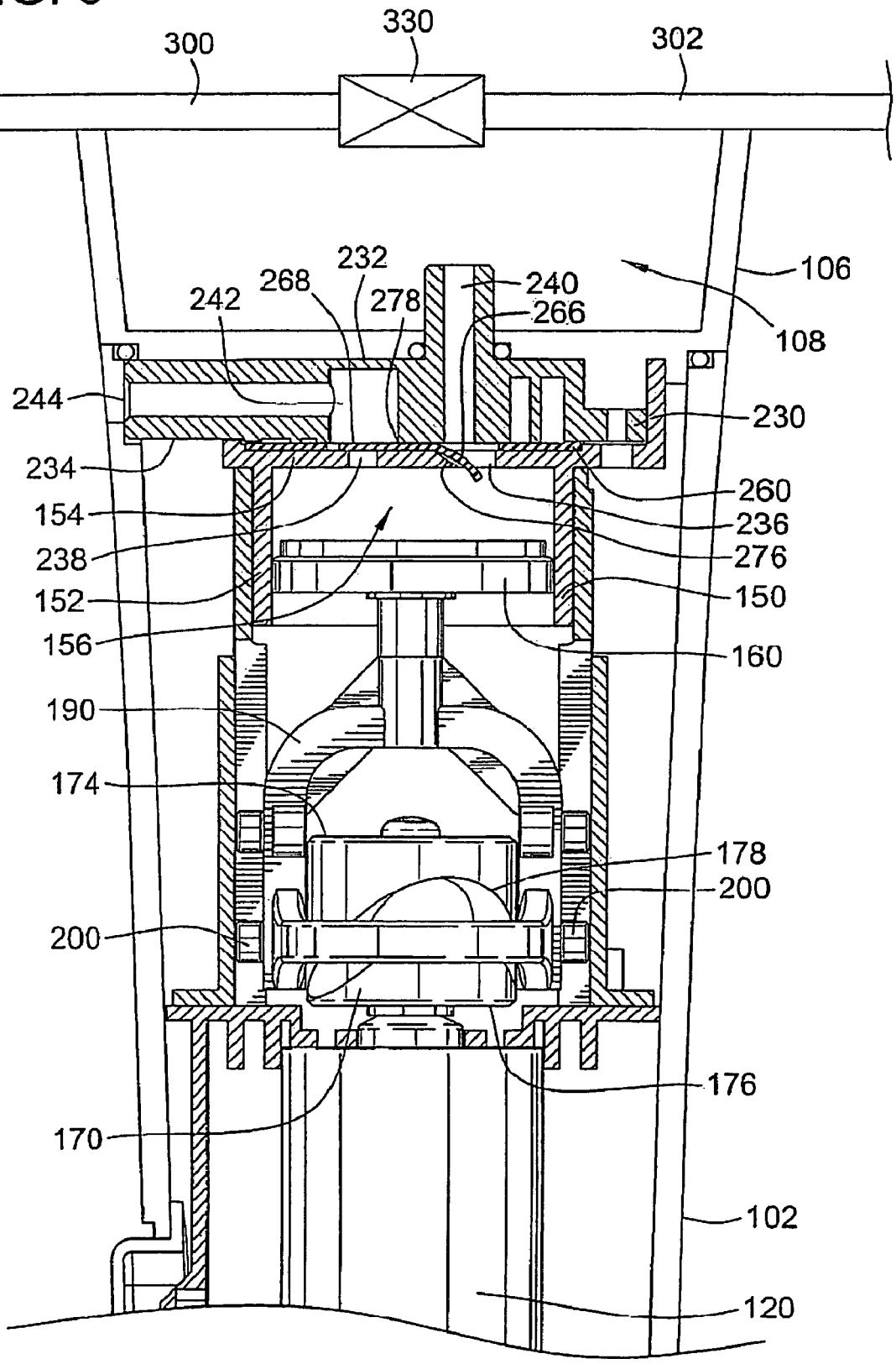
FIG. 5 is an elevational cross-sectional view similar to that taken along line 2-2 showing the evacuation device engaging a container and conducting an intake stroke during operation.
Figure 6:
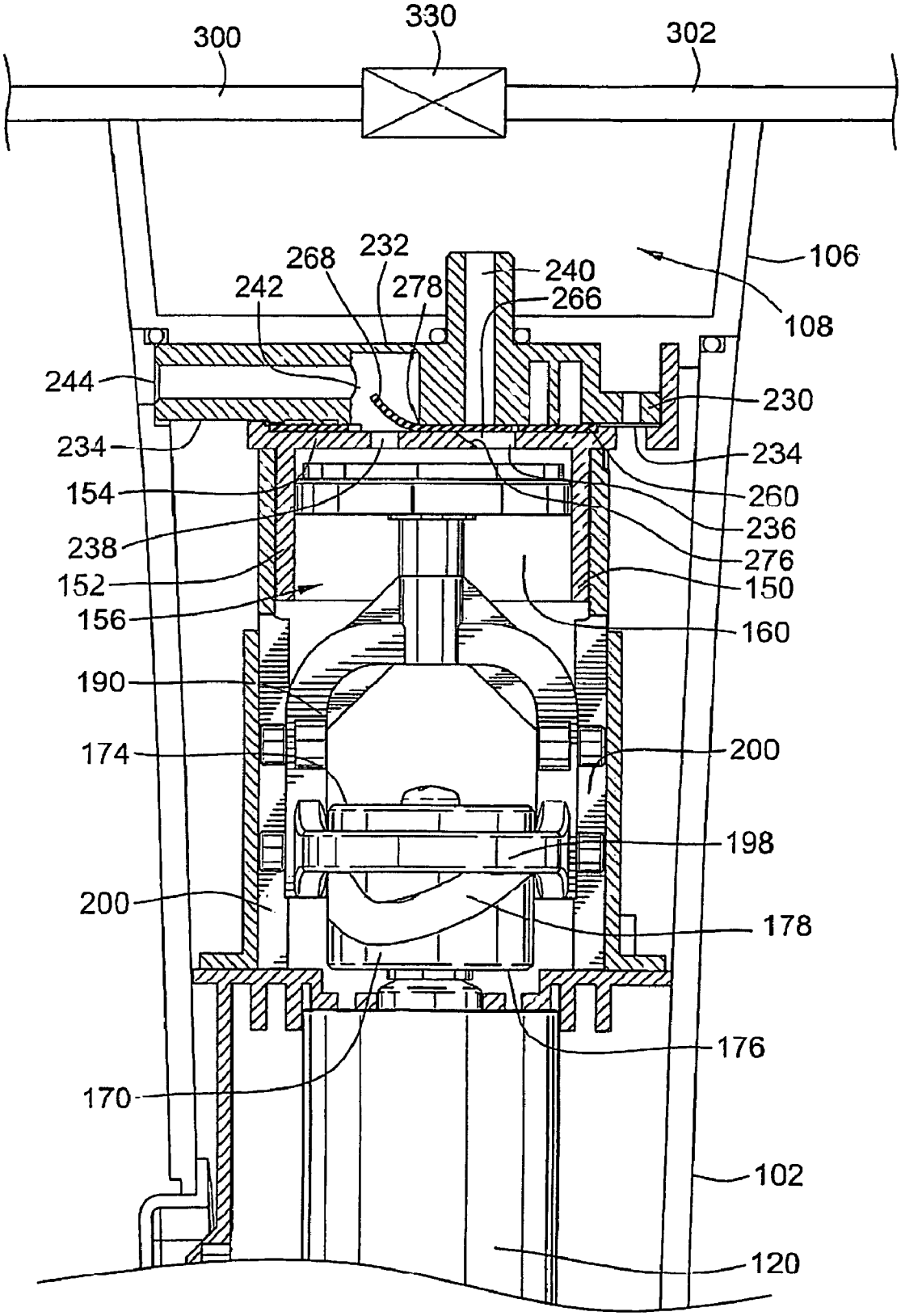
FIG. 6 is a elevational cross-sectional view similar to that taken along line 2-2 showing the evacuation device engaging a container and conducting an exhaust stroke during operation.

To convert the pumping action of the reciprocal device into alternating suction and exhaustion forces that can remove air from a container, as illustrated in FIGS. 2 and 3, the evacuation device includes a manifold 230 and a valve plate 260. Referring to FIGS. 5 and 6, the manifold 230 is located proximate the skirt-like nozzle 106 and has a first side surface 232 and an opposing second side surface 234. The first side surface 232 is exposed to the intake volume 108 outlined by the skirt-like nozzle 106 and the second side surface 234 is directed rearwardly toward the chamber body 150 and the reciprocal element 160. To accommodate fluid communication, the manifold 230 has disposed into it an inlet channel 240 and a separate outlet channel 242. The inlet channel 240 is disposed from the first side surface 232 to the second side surface 234 while the outlet channel 242 extends from the second side surface to an exhaust port 244 exposed through the housing 102.

To complete fluid communication between the manifold 230 and the chamber 156, there are disposed through the axial face wall 154 of the chamber body 150 an inlet aperture 236 and an outlet aperture 238. The inlet aperture 236 and the outlet aperture 238 are positioned so as to align with the locations where the respective inlet channel 240 and outlet channel 242 are exposed on the second side surface 234 of the manifold 230.

To control fluid communication between the inlet and outlet channels 240, 242 and the inlet and outlet apertures 236, 238, the valve plate 260 is positioned between the manifold 230 and the axial face wall 154 of the chamber body 150. As best illustrated in FIG. 3, the valve plate 260 is a planar, circular structure that can be made of any suitable flexible material such as an elastomer or a thin metal stamping. Disposed into the valve plate 260 are two opposing C-shaped slits 262, 264 that respectively outline an inlet flapper valve 266 and an outlet flapper valve 268.

To enable the flapper valves 266, 268 to control communication between the inlet and outlet channels 240, 242 and apertures 236, 238, referring to FIGS. 5 and 6, counter-bores, counter-sinks, or similar structures are disposed into the manifold 230 and chamber body 150. Specifically, a first counter-bore 276 is disposed into the axial face wall 154 of the chamber body 150 proximate the inlet aperture 236. Similarly, a second counter-bore 278 is disposed into the second side surface 234 of the manifold 230 proximate the outlet channel 242. The first and second counter-bores 276, 278 are sized and shaped to accommodate a flapper valve deflecting out of the plane of the valve plate 260.

In operation, the skirt-like nozzle 106 of the evacuation device 100 is placed against the sidewall 302 of a container 300 so that an attached valve element 330 is in sealed communication with the intake volume 108. Referring to FIG. 5, in the evacuation device during intake, the cam 170 is rotated so as to move the follower elements 200 in the channel 178 toward the second end face 176. This action moves the yoke 190 so as to displace the reciprocal element 160 linearly rearward in the chamber body 150 thereby expanding the space between the reciprocal element 160 and the axial face wall 154. As will be appreciated by those of skill in the art, the expanding space increases volume and relatedly lowers pressure in the chamber 156.

The pressure change in the chamber 156 causes the inlet flapper valve 266 to deflect into the first counter-bore 276 thereby allowing air to be drawn from the inlet volume 108 via the inlet channel 240 and into the inlet aperture 236 and thus the chamber 156. At the same time, the reduced pressure in the chamber causes the outlet flapper valve 268 to deflect against the axial side wall 154 of the chamber body 150 to cover and seal the outlet aperture 238. Sealing the outlet aperture 238 ensures that air drawn into the chamber 156 is primarily from the intake volume 108 via the inlet channel 240 thus increasing the efficiency of the evacuation device.

Referring to FIG. 6, to exhaust air from the chamber 156, the cam 170 is rotated to move the follower elements 200 within the channel 178 toward the first face 178. This causes forward displacement of the yoke 190 and the connected reciprocal element 160 thereby causing the space between the axial face wall 154 and the reciprocal element 160 to decrease. The decreased space relatedly decreases the volume and raises the pressure in the chamber.

The increased pressure causes the inlet flapper valve 266 to deflect against the second side surface 234 of the manifold 230 thereby sealing the inlet aperture 240. At the same time, the outlet flapper valve 268 deflects into the second counter-bore 278 unsealing the outlet aperture 238 and allowing communication of air between the chamber 156 and the outlet channel 242 in the manifold 230. The communicated air can be discharged via the exhaust port 244 on the exterior of the evacuation device 100.

Figure 7:
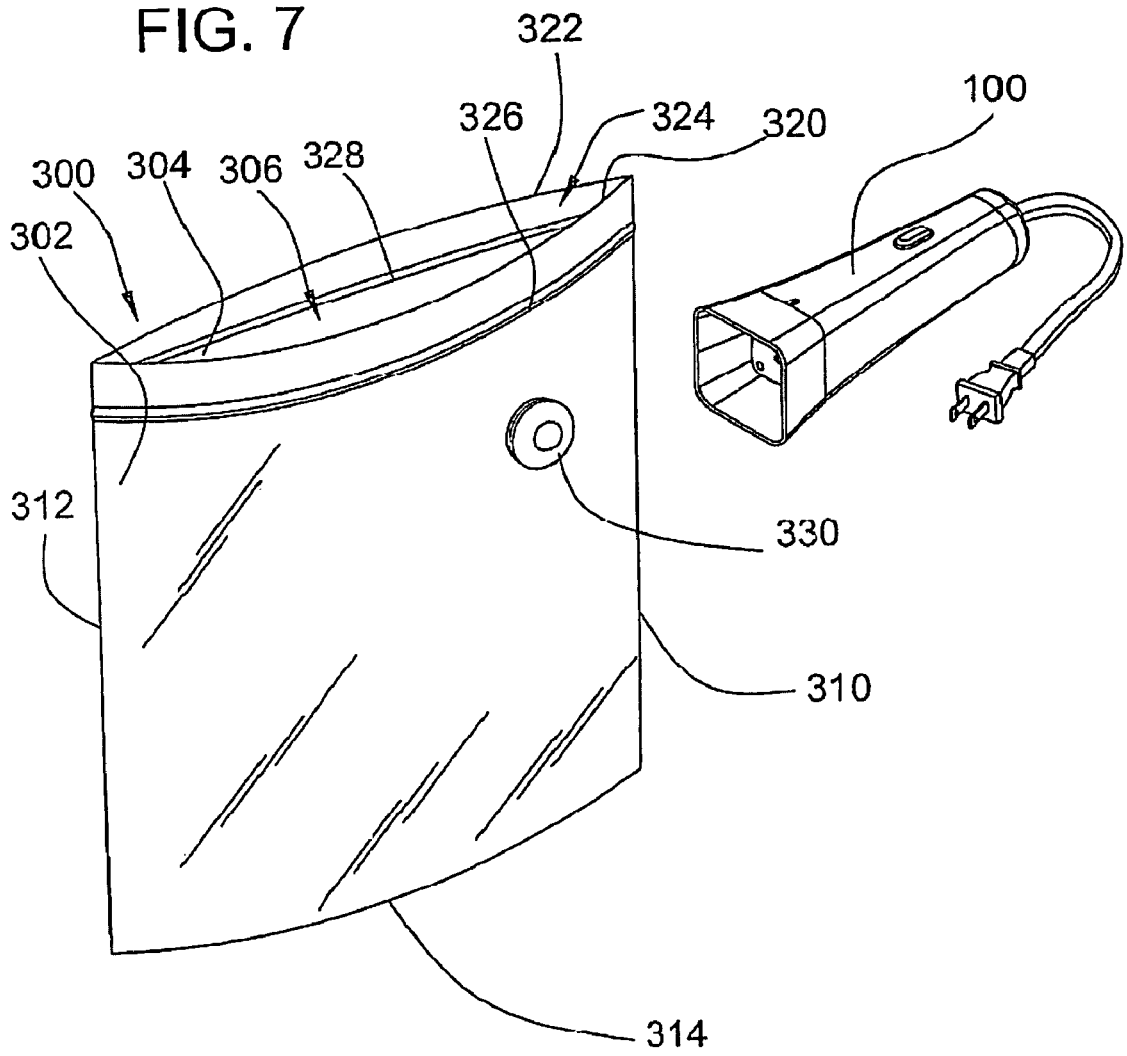
FIG. 7 is a perspective view of the evacuation device and a storage bag.

Referring to FIG. 7, the evacuation device 100 is shown with a storage bag 300. The storage bag 300 can be used for storing items such as food stuffs. In the illustrated embodiment, the storage bag 300 is made from a first sidewall 302 and an opposing second sidewall 304 overlying the first side wall to provide an interior volume 306 therebetween. The first and second sidewalls 302, 304 are joined along a first side edge 310, a parallel or non-parallel second side edge 312, and a closed bottom edge 314 that extends between the first and second side edges. The first and/or second sidewalls 302, 304 may be made from a flexible or pliable thermoplastic material formed or drawn into a smooth, thin walled sheet. Examples of suitable thermoplastic materials include high density polyethylene (HDPE), low density polyethylene (LDPE), polypropylene (PP), ethylene vinyl acetate (EVA), nylon, polyester, polyamide, ethylene vinyl alcohol, and can be formed in single or multiple layers. The thermoplastic material can be transparent, translucent, opaque, or tinted. Furthermore, the material used for the sidewalls can be a gas impermeable material. The sidewalls 302, 304 can be joined along the first and second side edges 310, 312 and bottom edge 314 by any suitable process such as, for example, heat sealing.

For accessing the interior volume 306, the top edges 320, 322 of the first and second sidewalls 302, 304 remain unjoined to define an opening 324. To seal the opening 324, first and second interlocking fastening strips 326, 328 can be attached to the interior surfaces of the respective first and second sidewalls 302, 304. The first and second fastening strips 326, 328 extend generally between the first and second side edges 310, 312 parallel to and spaced below the top edges 320, 322. In other embodiments, the bag 300 can include a movable slider straddling the fastening strips 326, 328 to facilitate occluding and deoccluding of the opening 324.

To evacuate the storage bag 300 of latent or entrapped air after the opening has been closed, a one-way valve element 330 designed in accordance with the teachings of the invention is provided. The valve element 330 is attached to the first flexible sidewall 302 and communicates with the interior volume 306. In one embodiment, the one-way valve element 330 is configured to open under an applied pressure differential thereby allowing air from the interior volume 306 to escape and to close after elimination or reduction of the pressure differential thereby preventing the ingress of environmental air into the interior volume. To establish the pressure differential, the vacuum device 100 can be used. When activated, the vacuum device draws air from the interior volume 306 through the valve element 330.

Figure 8:
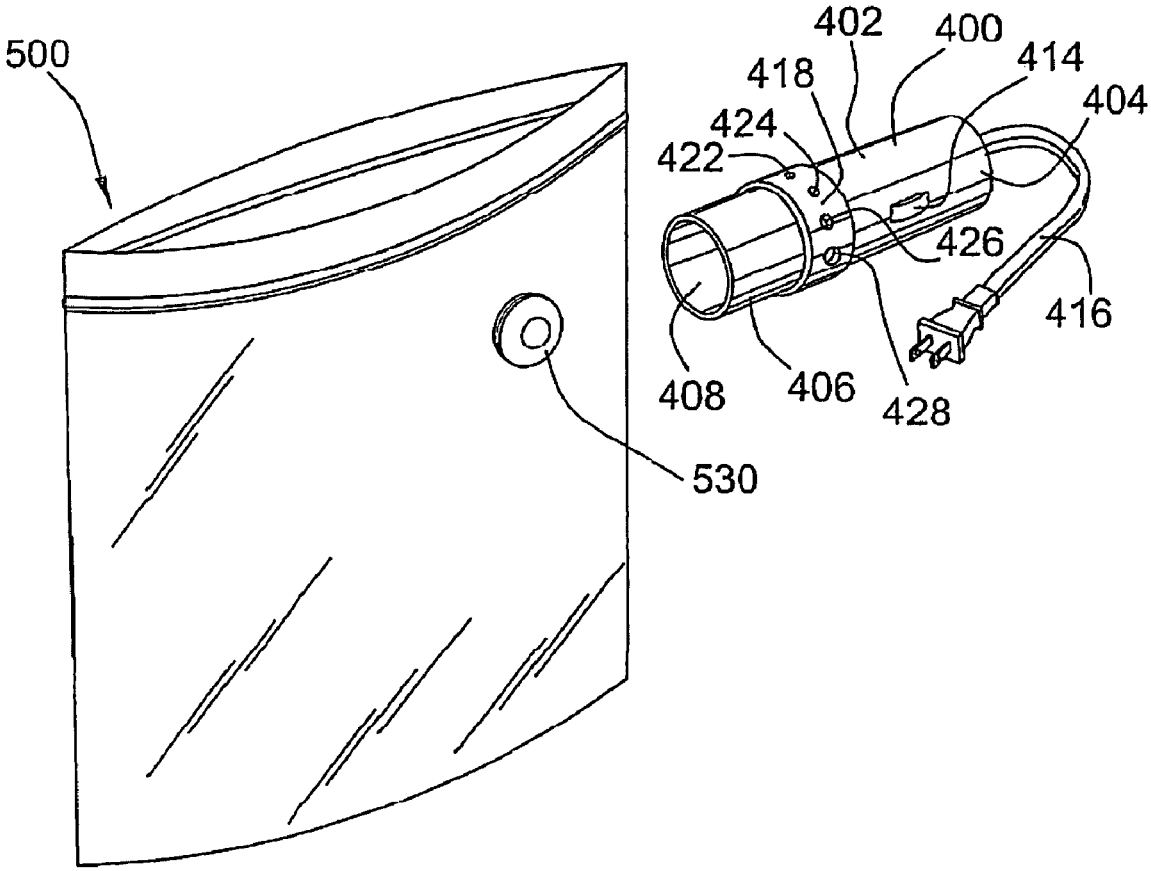
FIG. 8 is a perspective view of another embodiment of an evacuation device with a pressure adjustment feature.

Referring to FIG. 8, another embodiment of an evacuation device 400 is shown with a storage bag 500. The storage bag 500 is similar to storage bag 300 which is described above. The evacuation device 400 may include a housing 402 with an end 404 and a nozzle 406 which outlines an intake volume 408. The evacuation device 400 may include a switch 414 and a power cord 416. The evacuation device 400 may also include a pressure adjustment feature 418.

The pressure adjustment feature 418 allows the user to adjust the pressure of the evacuation device. When vacuum packing in a flexible material, such as bags, different types of foods require a different amount of maximum internal pressure. For example, soft airy foods, such as bread may require much less vacuum pressure than freezer foods, such as meat. When dry goods are packed with large amounts of pressure, the pressure could crush the foods and may cause pin holes in the bag sidewalls. Thus, high pressure could turn a bag filled with crackers into cracker crumbs.

In one embodiment, the pressure adjustment feature 418 includes a rotating ring 420 with one or more holes. In one embodiment, the ring 420 may include holes 422, 424, 426, 428. Each of the successive holes are greater in diameter than the adjacent hole. For example, hole 424 is larger than hole 422, hole 426 is larger than hole 424, and hole 428 is larger than hole 426.

Figure 9:
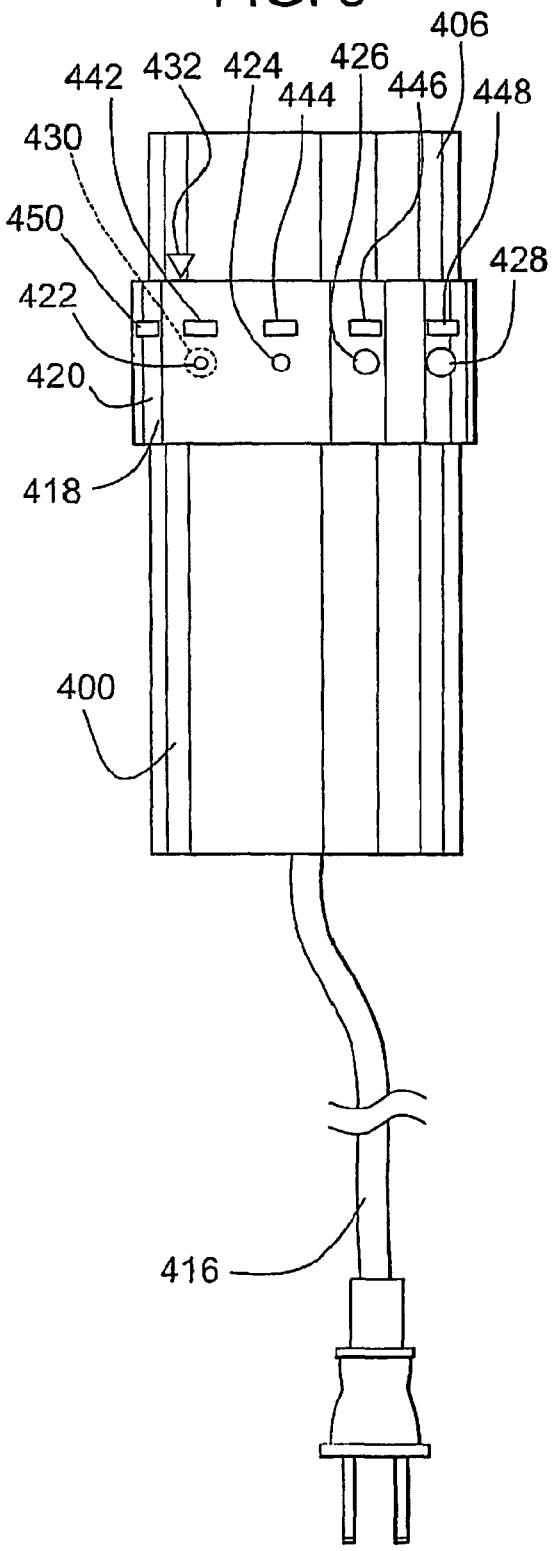
FIG. 9 is a plan view of the evacuation device shown in FIG. 8.
Figure 10:
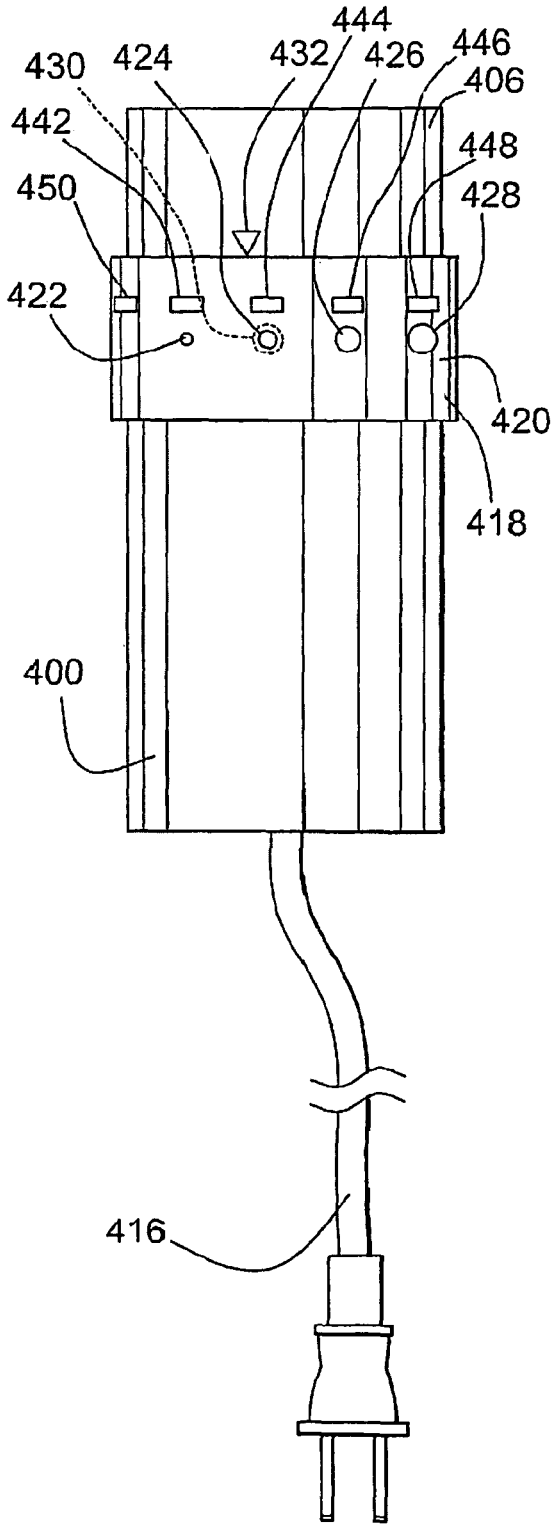
FIG. 10 is a plan view of the evacuation device shown in FIG. 9 with the pressure adjustment feature shown in a different position.

The nozzle 406 includes an aperture 430. The aperture 430 may be aligned with one of the holes 422, 424, 426, 428 in order to adjust the pressure of the evacuation device. For example, in FIG. 9, aperture 430 is aligned with hole 422. Conversely, referring to FIG. 10, the aperture 430 is aligned with hole 424.

When the ring 420 is rotated to expose a hole, air is allowed to flow through the corresponding hole. Thus, the pressure inside the nozzle and correspondingly inside the bag, would be reduced. For soft airy food, such as bread, a large hole, such as hole 428 would be exposed. For hard, dry goods, such as pretzels or crackers, a smaller hole would be exposed, such as hole 422. For freezer goods, such as meats or chicken, all of the holes would be covered.

In order to assist the user in selecting an appropriate pressure, the aperture 430 in the nozzle includes an indicator 432. In addition, the holes 422, 424, 426, 428 may also include indicia 442, 444, 446, 448. Thus, for example, indicia 442 may state "dry goods". As another example, indicia 448 may state "soft bread". In addition, a further indicia 450 may state "meat" and would correspond to a position with the aperture 430 being covered.

The user would then rotate the ring to align the indicator 432 with the indicia 442, 444, 446, 448, 450 to correspond with the items being placed in the bag for storage. The user would then place the items in the bag and close the bag opening. The user would then activate the evacuation device 400 and place the nozzle 406 over the valve 530 on the bag. The evacuation device would apply a vacuum and the vacuum pressure would be reduced if one of the holes on the rotation ring is exposed. By allowing air to enter the exposed hole, the amount of vacuum pressure at the nozzle and the bag is reduced.

In addition to preventing food damage, the adjustment feature would help in eliminating pin holes in the bag sidewalls. The hard, sharp edges of dry goods, such as pretzels, have a tendency to poke through the film and create a pin hole. When a pin hole is created, the vacuum in the storage bag is lost. Thus, by controlling the amount of vacuum that is applied to the inside of the bag, the number of pin holes created by the hard, sharp edges of dry goods will be reduced or eliminated.

Referring to FIGS. 11, 12, and 13, the one-way valve element 600 for use with a storage bag of the foregoing type can include a rigid valve body 610 that cooperates with a movable disk 612 to open and close the valve element. The valve body 610 includes a circular flange portion 614 extending between parallel first and second flange faces 620, 622. Concentric to the flange portion 614 and projecting from the second flange face 622 is a circular boss portion 618 which terminates in a planar boss face 624 that is parallel to the first and second flange faces. The circular boss portion 618 is smaller in diameter than the flange portion 614 so that the outermost annular rim of the second flange face 622 remains exposed. The valve body 610 can be made from any suitable material such as a moldable thermoplastic material like nylon, HDPE, high impact polystyrene (HIPS), polycarbonates (PC), and the like.

Disposed concentrically into the valve body 610 is a counter-bore 628. The counter-bore 628 extends from the first flange face 620 part way towards the boss face 624. The counter-bore 628 defines a cylindrical bore wall 630. Because it extends only part way toward the boss face 624, the counter-bore 628 forms within the valve body 610 a preferably planar valve seat 632. To establish fluid communication across the valve body 610, there is disposed through the valve seat 632 at least one aperture 634. In fact, in the illustrated embodiment, a plurality of apertures 634 are arranged concentrically and spaced inwardly from the cylindrical bore wall 630.

To cooperatively accommodate the movable disk 612, the disk is inserted into the counter-bore 628. Accordingly, the disk 612 is preferably smaller in diameter than the counter-bore 628 and has a thickness as measured between a first disk face 640 and a second disk face 642 that is substantially less than the length of the counter-bore 628 between the first flange face 620 and the valve seat 632. To retain the disk 612 within the counter-bore 628, there is formed proximate to the first flange face 620 a plurality of radially inward extending fingers 644. The disk 612 can be made from any suitable material such as, for example, a resilient elastomer.

Referring to FIG. 13, when the disk 612 within the counter-bore 628 is moved adjacent to the fingers 644, the valve element 600 is in its open configuration allowing air to communicate between the first flange face 620 and the boss face 624. However, when the disk 612 is adjacent the valve seat 632 thereby covering the apertures 634, the valve element 600 is in its closed configuration. To assist in sealing the disk 612 over the apertures 634, a sealing liquid can be applied to the valve seat 632. Furthermore, a foam or other resilient member may be placed in the counter-bore 628 to provide a tight fit of the disk 612 and the valve seat 632 in the closed position.

Figure 16:
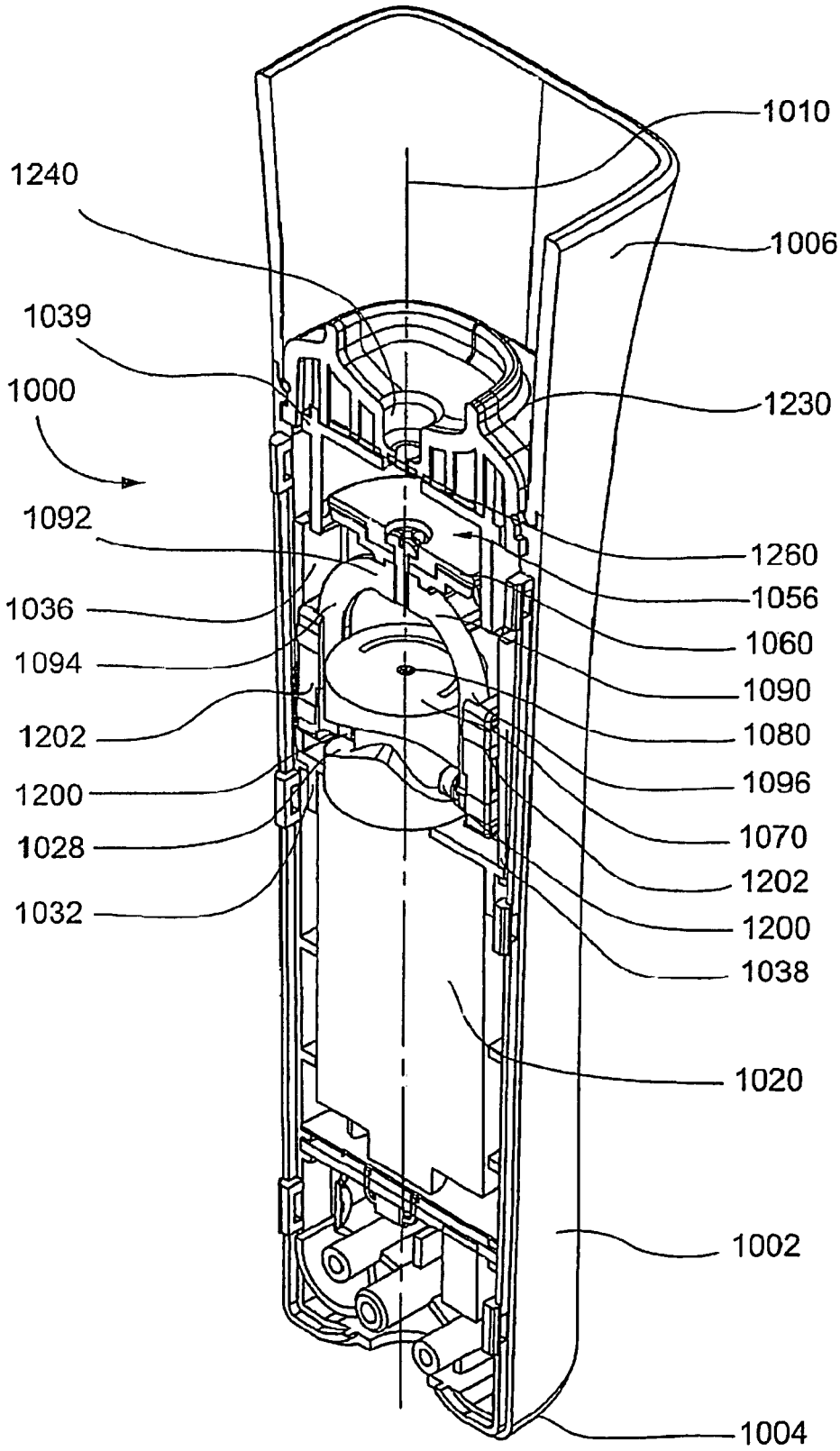
FIG. 16 is a perspective cross-sectional view similar to that taken along line 2-2 of FIG. 1 showing the internal components of another embodiment of the evacuation device configured with a vacuum control valve.

To attach the valve element 600 to the first sidewall, referring to FIG. 16, an adhesive can be applied to the exposed annular rim portion of the second flange face 622. The valve element 600 can then be placed adjacent the exterior surface of the first sidewall with the boss portion 618 being received through the hole disposed into the sidewall and thereby pass into the internal volume. Of course, in other embodiments, adhesive can be placed on other portions of the valve element, such as the first flange face, prior to attachment to the sidewall.

In other embodiments, the one-way valve element can have a different construction. For example, the one-way valve element can be constructed from flexible film materials similar to those disclosed in U.S. Pat. Nos. 2,927,722, 2,946,502, and 2,821,338, all incorporated by reference in their entirety.

Figure 14:
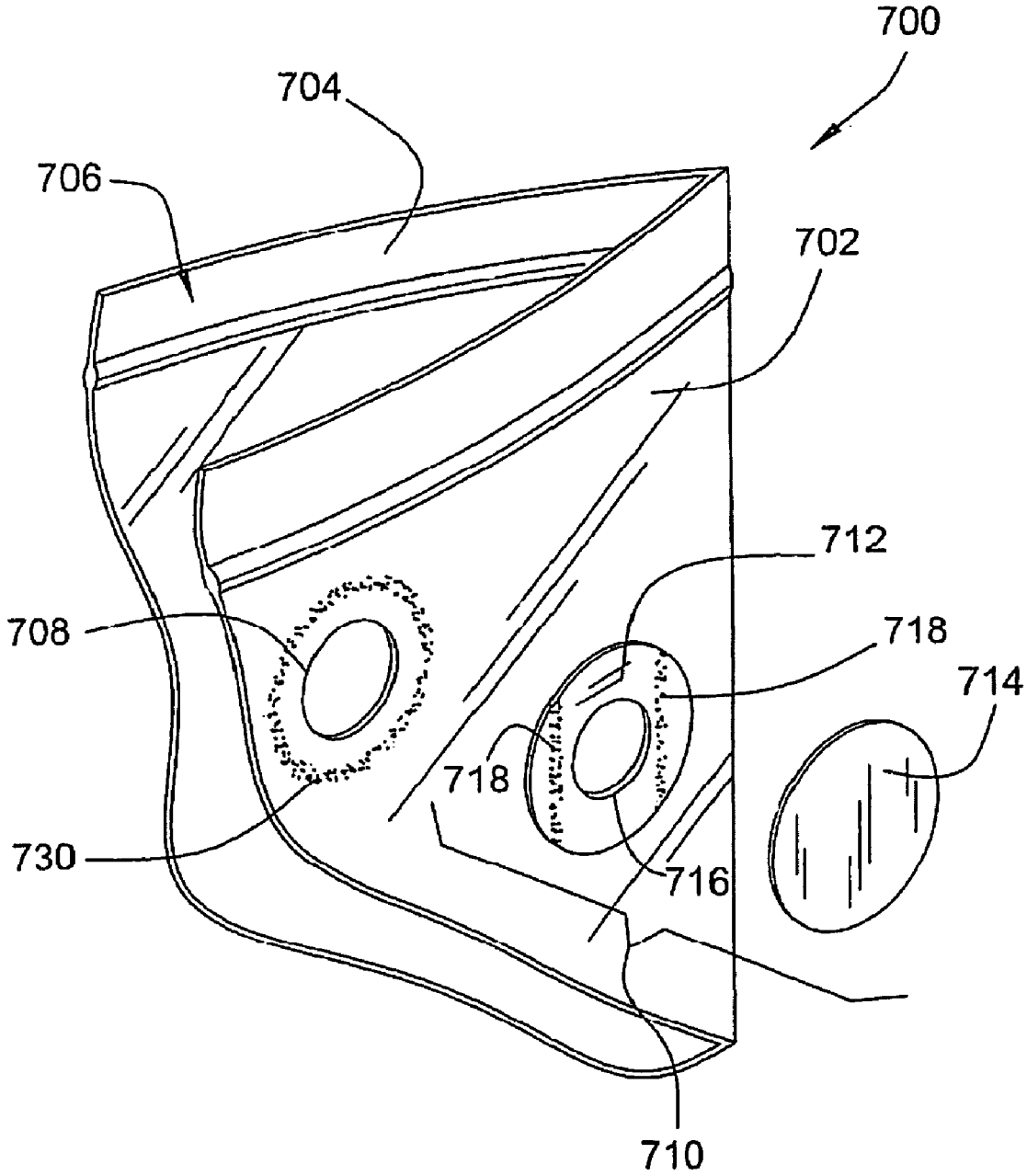
FIG. 14 is an exploded view of another embodiment of the one-way valve element for attachment to the flexible bag.

As illustrated in FIG. 14, such a flexible one-way valve element 710 made in accordance with this style can include a flexible, circular base layer 712 that cooperates with a correspondingly circular shaped, resilient top layer 714 to open and close the valve element. The top and bottom layers can be made from any suitable material such as, for example, a flexible thermoplastic film. Disposed through the center of the base layer 712 is an aperture 716, thus providing the base layer with an annular shape. The top layer 714 is placed over and adhered to the base layer 712 by two parallel strips of adhesive 718 that extend along either side of the aperture 716, thereby covering the aperture with the top layer and forming a channel. The base layer 712 is then adhered by a ring of adhesive 720 to the flexible bag 700 so as to cover the hole 708 disposed through the first sidewall 702.

As will be appreciated by those of skill in the art, when a pressure differential is applied across the valve element by, for example, placing the nozzle of an evacuation device adjacent the first sidewall 702 about the valve element, the top layer 714 can be partially displaced from the base layer 712 thereby exposing the aperture 716. Air from the interior volume 706 can pass through the hole 708 and aperture 716 and along the channel formed between the adhesive strips 718 where the removed air enters the evacuation device. When the suction force generate by the evacuation device is removed, the resilient top layer 714 will return to its prior configuration covering and sealing the aperture 716. The valve element 710 may also contain a viscous material such as an oil, grease, or lubricant between the two layers in order to prevent air from reentering the bag. In an embodiment, base layer 712 may also be a rigid sheet material.

Figure 15:
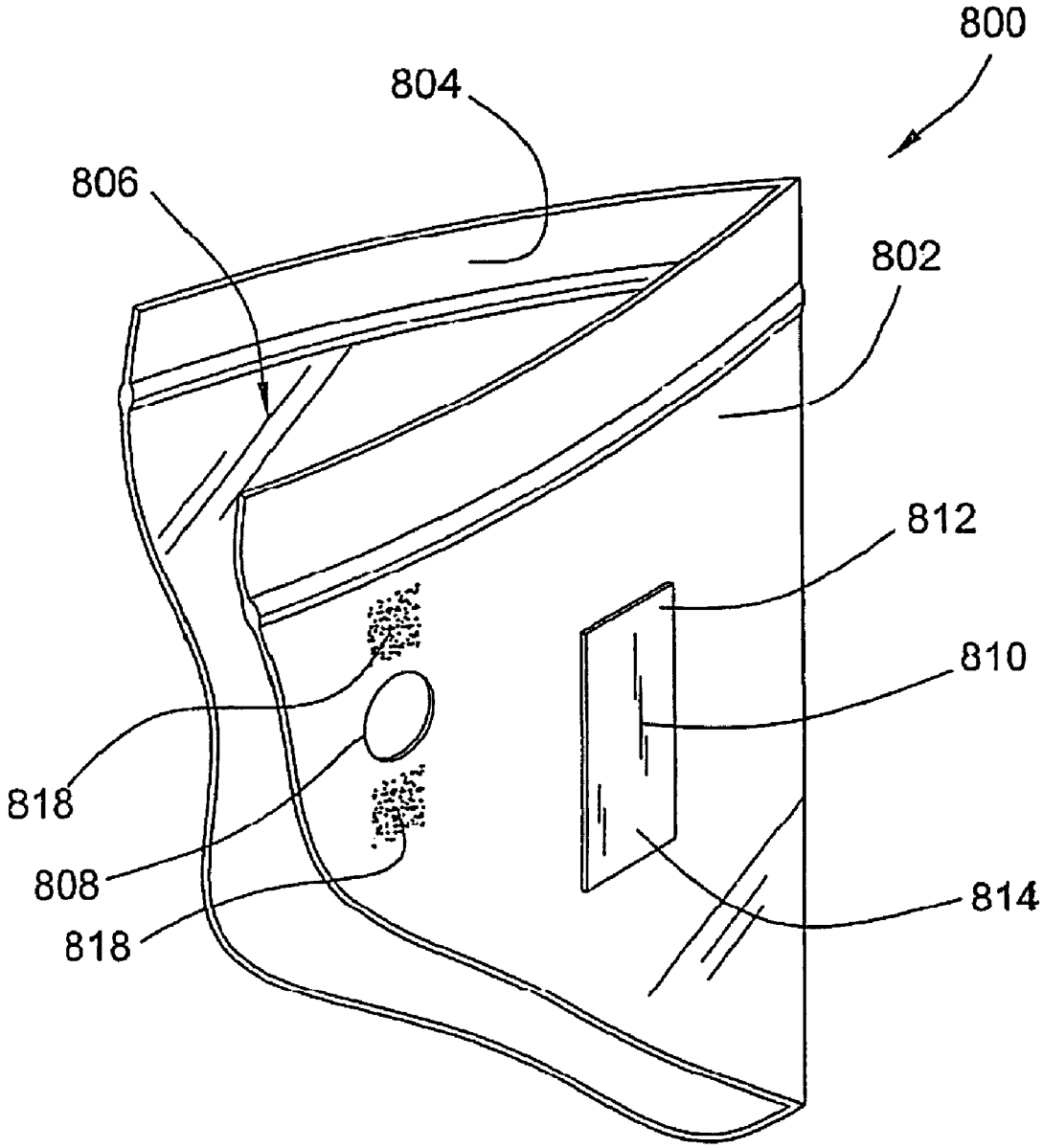
FIG. 15 is an exploded view of another embodiment of the one-way element for attachment to the flexible bag.

Illustrated in FIG. 15 is another embodiment of the valve element 810 that can be attached to the flexible plastic bag 800. The valve element 810 is a rectangular piece of flexible thermoplastic film that includes a first end 812 and a second end 814. The valve element 810 is attached to the first sidewall 802 so as to cover and seal a hole 808 disposed through the first sidewall. The valve element 810 can be attached to the sidewall 802 by patches of adhesive 818 placed on either side of the hole 808 so as to correspond to the first and second ends 812, 814. When the nozzle attached to an evacuation device is placed adjacent the first sidewall 802 about the valve element 810, air from the internal volume 806 displaces the flexible valve element 810 so as to unseal the hole 808. After evacuation of air from the internal volume 806, the valve element 810 will again cover and seal the hole 808.

Figure 17:
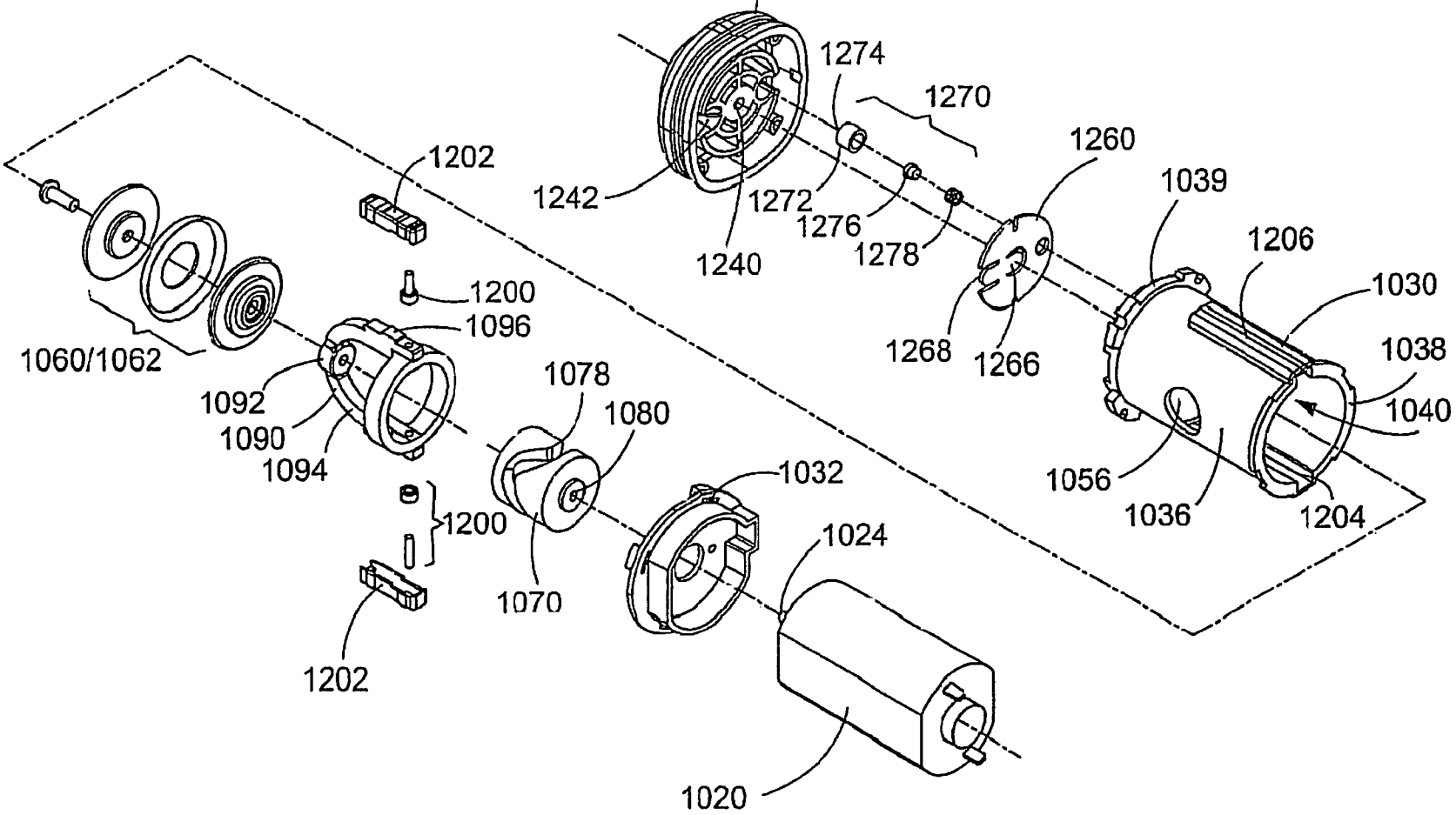
FIG. 17 is a perspective exploded view of the embodiment of the evacuation device of FIG. 16.

Referring to FIGS. 16 and 17, there is illustrated another embodiment of an evacuation device 1000 that incorporates additional or different features and advantages. As described above, the evacuation device 1000 includes an elongated housing 1002 that extends between a closed rearward end 1004 and a skirt-like forward nozzle end 1006. Again for purposes of reference, an axis line 1010 extends between the closed rearward end 1004 and the forward nozzle end 1006. To provide power, the evacuation device 1000 includes an electric motor 1020 located inside the housing 1002 and situated toward the rearward end 1004. Extending forwardly from the motor 1020 along the axis line 1004 is a rotatable motor shaft 1024.

To provide pumping action, the evacuation device 1000 includes an operatively associated reciprocal element 1060, a cam 1070 and a yoke 1090 which are accommodated in a bore housing 1030. When assembled the bore housing 1030 connects via its rearward first end 1038 to a bore interface plate 1032 that is fixedly mounted onto the front face of the motor 1020. The bore housing 1030 includes a tubular body 1036 that provides a cylindrical, axially aligned bore 1040 extending from the first end 1038 toward a forwardly located and closed second end 1039. Integrally formed with the bore housing 1030 and proximate the closed second end 1039 is the chamber 1056 that can reciprocally receive the reciprocal element 1060. Referring to FIG. 17, the reciprocal element 1060 can again take the form of a multi-component piston 1062 located axially forward of the motor 1020.

To drive the reciprocal element 1060 within the chamber 1056, the cam 1070 can have a cylindrical shape with a channel 1078 disposed into the cylindrical sidewall. The cam 1070 also includes a central bore 1080 that enables mounting of the cam to the motor shaft 1024 in a manner such that the cam aligns with the axis line 1010. To connect the reciprocal element 1060 to the cam 1070, the yoke 1090 is provided. The yoke 1090 includes first and second bifurcated arms 1094, 1096 which extend from a common junction 1092 rearwardly about the cam 1070. To engage the cam 1070, there can be attached near the distal ends of the first and second arms 1094, 1096 follower elements 1200 that can be received in the channel 1078.

To align the yoke 1090 within the bore 1040, sliders 1202 can be provided on part of the yoke 1090. The sliders 1202 may be made from a low friction material such as plastic and can be attached to the outsides of the first and second arms 1094, 1096, such as by snap fitting or by another suitable attachment method. To accommodate the sliders 1202, there are disposed in the bore housing 1034 along opposing sides of the bore 1040 first and second guide slots 1204, 1206. When the evacuation device is assembled, the sliders 1202 attached to the yoke 1090 are received in the guide slots 1204, 1206 so that the yoke is constrained against rotation. Hence, rotation of the cam 1070 causes the channel 1078 to drive the follower elements 1200 attached to the yoke 1090 which results in linear translation of the reciprocal element 1060.

To convert motion of the reciprocal element to alternating suction and exhaustion forces, the evacuation device includes a manifold 1230 into which inlet channels 1240 and outlet channels 1242 are disposed. The manifold 1230 can be placed adjacent to the forward second end 1039 of the bore housing 1030 so that the manifold can interact with the chamber 1056. To control the flow of air through the manifold 1230 and chamber 1056, a valve plate 1260 with an inlet flapper valve 1266 and an outlet flapper valve 1268 can be positioned between the manifold and the second end 1039 of the bore housing 1030.

Figure 18:
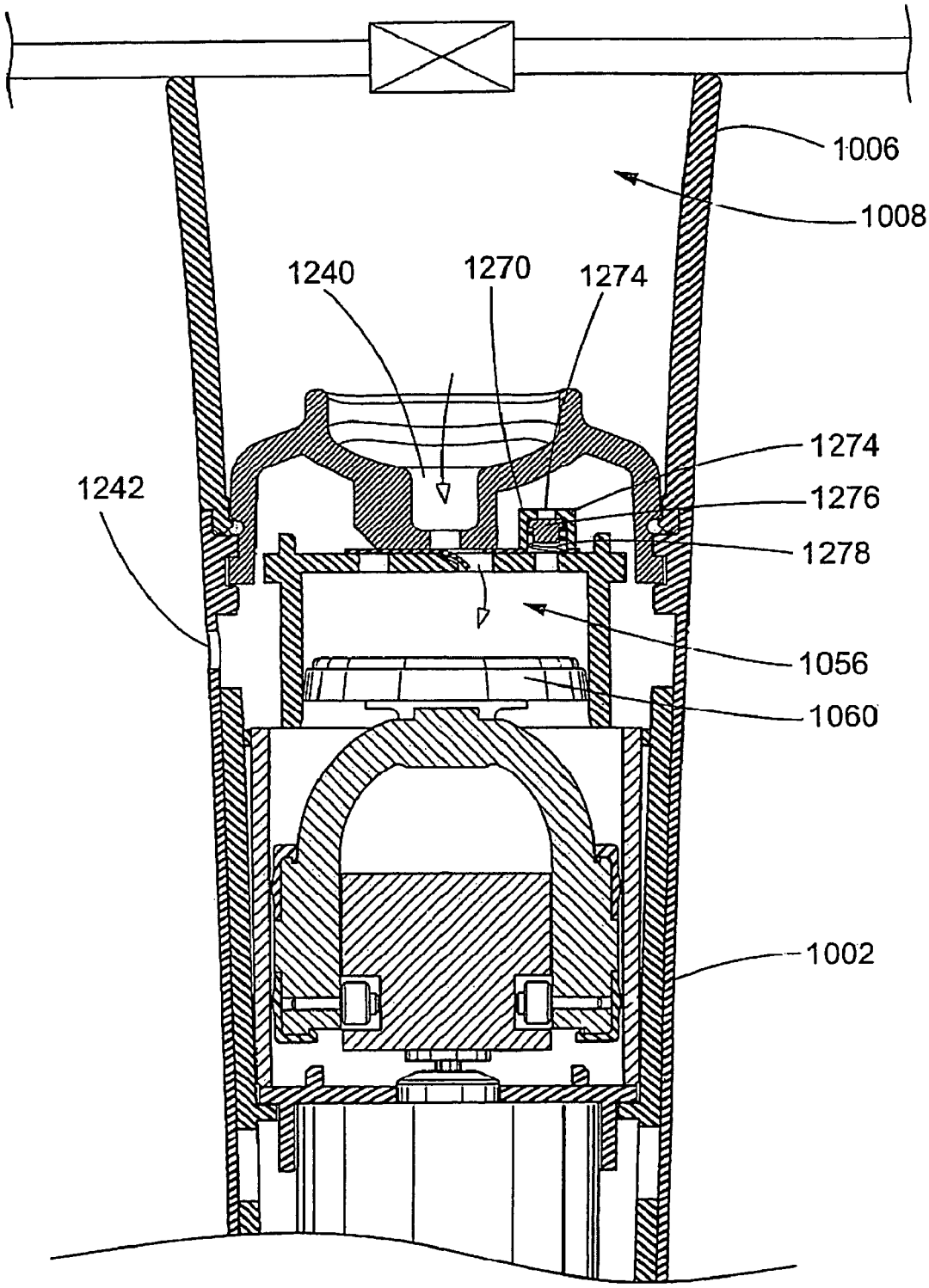
FIG. 18 is an elevational cross-sectional view showing the evacuation device of FIG. 16 engaging a container and conducting an intake stroke during operation with the vacuum control valve closed

Referring to FIGS. 17 and 18, to enable adjusting the vacuum pressure which the evacuation device 1000 can draw, the device can also include a pressure control valve 1270. In the illustrated embodiment, the pressure control valve 1270 includes a tubular, closed ended valve seat 1272 having a valve hole 1274 disposed therein, a valve disk 1276 receivable in the valve seat, and a spring 1278. The spring 1278 may have a spring constant that corresponds to a predetermined vacuum pressure which the evacuation device should be configured to apply. The pressure control valve 1270 can be located between manifold 1230 and the second end 1039 of the bore housing 1030 and can communicate with the chamber 1040 and the ambient environment surrounding the evacuation device.

Figure 19:
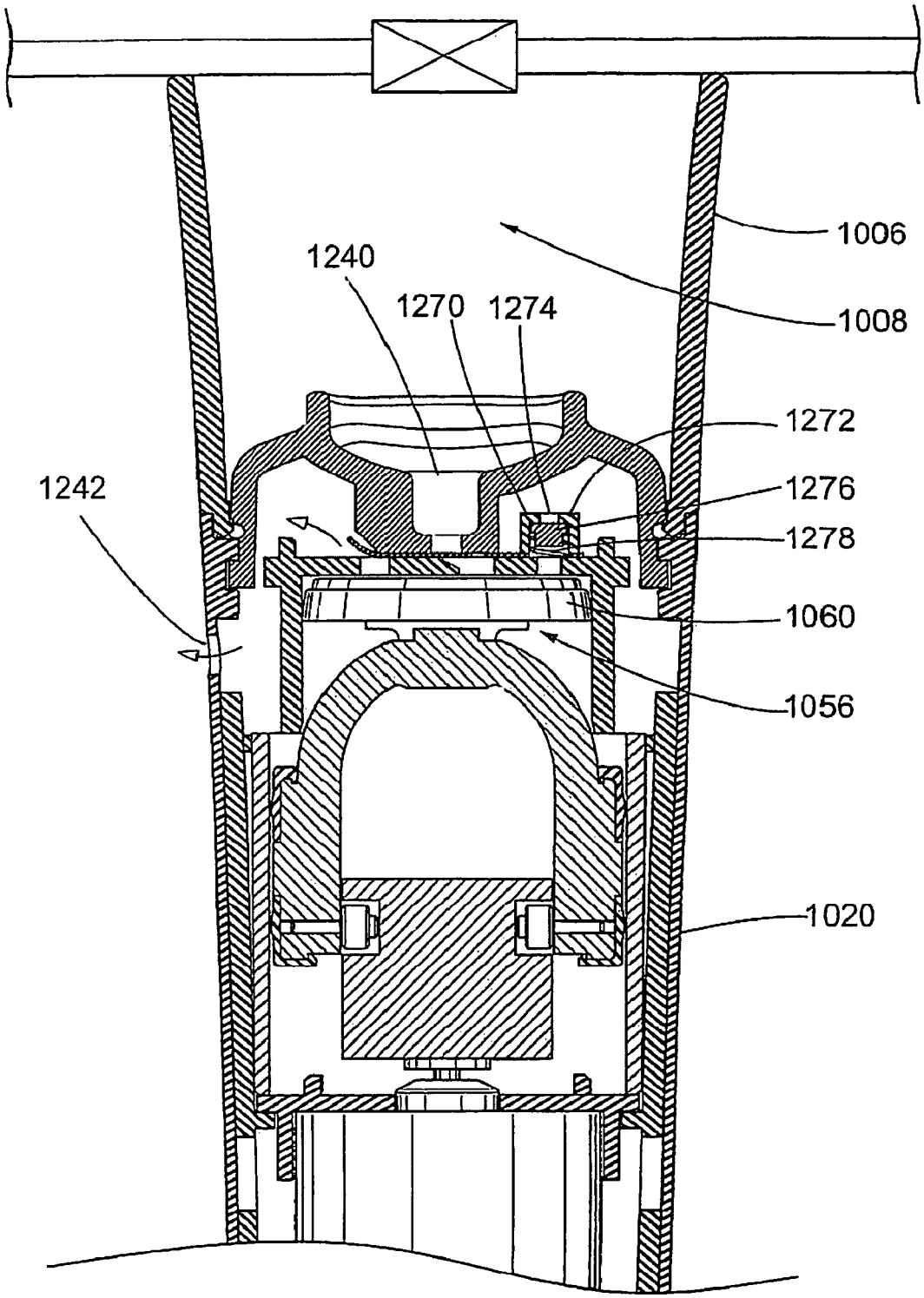
FIG. 19 is an elevational cross-sectional view showing the evacuation device of FIG. 16 engaging a container and conducting an exhaust stroke during operation with the vacuum control valve closed.
Figure 20:
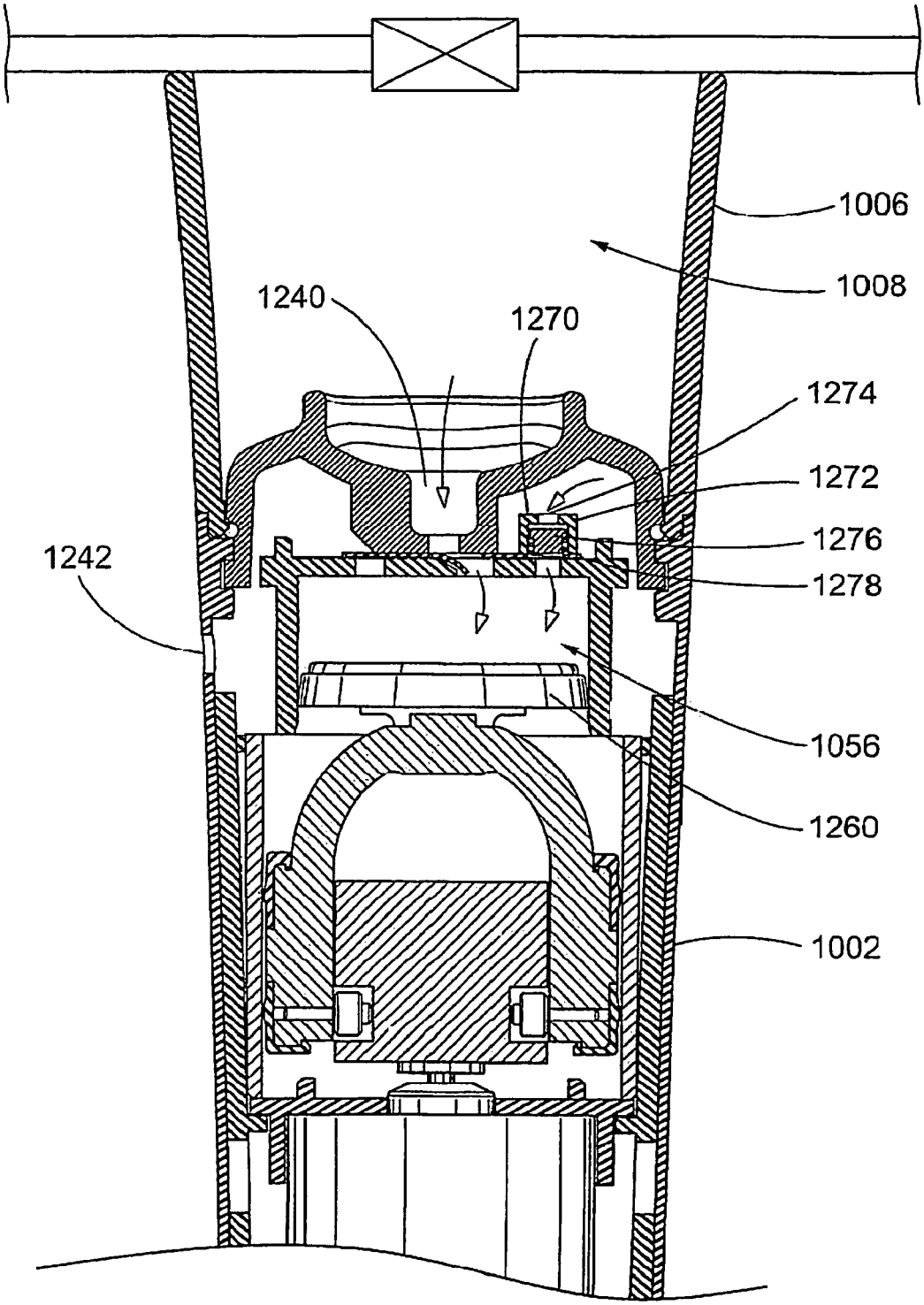
FIG. 20 is an elevational cross-sectional view similar to FIG. 18 with the valve control element opened.

Referring to FIGS. 18, 19, and 20 in operation under normal conditions, the spring 1278 biases the valve disk 1276 into and against the valve seat 1272 so as to seal the valve hole 1274. This includes during intake as illustrated in FIG. 18 when the reciprocal element 1060 is traveling rearward and thereby drawing air into the chamber 1056 and during exhaust as illustrated in FIG. 19 when the reciprocal element is traveling forward and thereby exhausting air from the chamber. As will be appreciated, during exhaustion the pressure inside the chamber 1056 is roughly equal to or less than the pressure in the intake volume 1008 as delineated by the forward nozzle end 1006 of the housing 1002. Referring to FIG. 20 though, when the vacuum pressure inside the chamber 1056 reaches the predetermined vacuum pressure of the device, the pressure differential existing across the pressure control valve 1270 between the ambient pressure and the chamber pressure becomes sufficient to overcome the biasing force of the spring 1278 and thereby displace the valve disk 1276. Displacement of the valve disk 1276 unblocks the hole 1274 allowing ambient air to enter the chamber 1056.

Bleeding ambient air into the chamber hence controls the vacuum pressure of the evacuation device thereby accomplishing some of the advantages mentioned above with respect to the pressure adjustment feature. Another advantage of the pressure control valve is that over-evacuation of the intake volume 1008 provided by the nozzle end 1006 of the housing 1002 is prevented. Hence, the vacuum pressure to which the bag and valve element are subjected to is limited and can be optimized to prevent damage to the same.

The pressure control valve 1270 may be used with any of the embodiments of the evacuation device disclosed herein.

Figure 21:
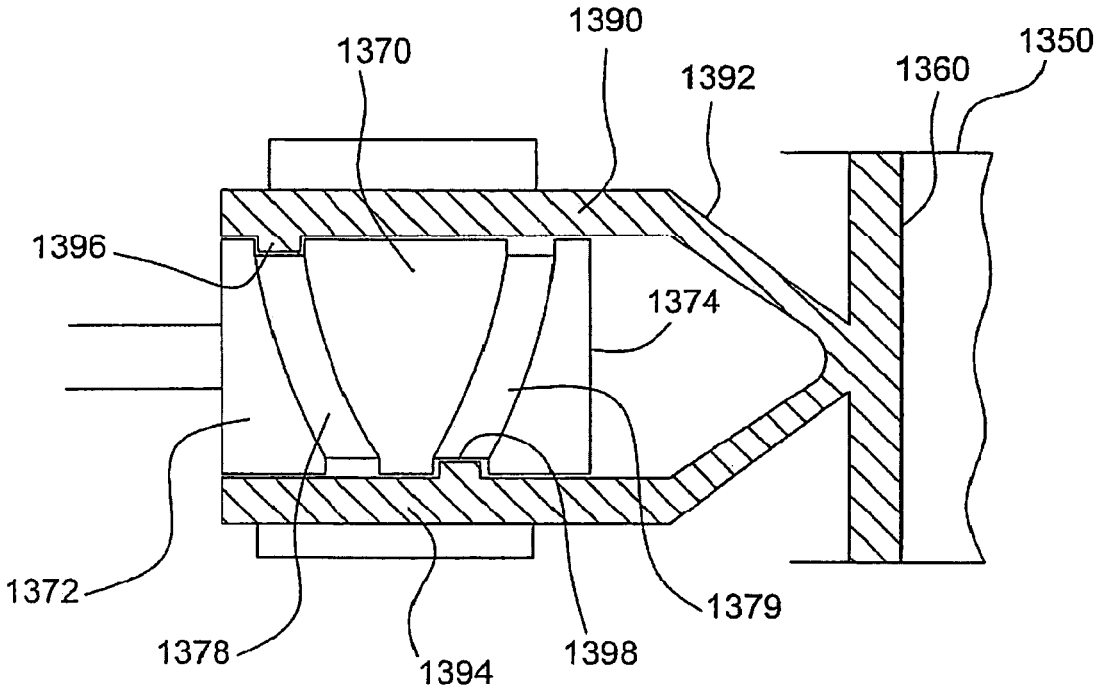
FIG. 21 is a schematic view of another embodiment of the cam and yoke configured to include first and second channels after completion of an intake stroke.
Figure 22:
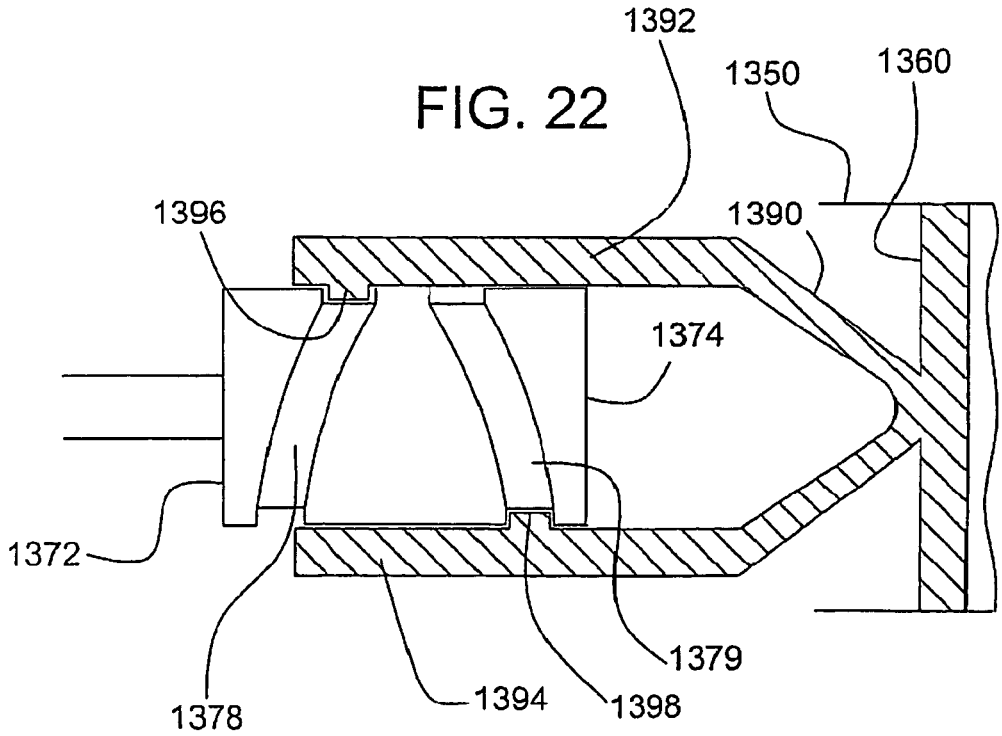
FIG. 22 is a schematic view of the cam and yoke of FIG. 21 after completion of an exhaust stroke.

Referring to FIGS. 21 and 22, there is illustrated schematically another embodiment of the cam 1370 and yoke 1390 components that can be used with the various embodiments of the evacuation device. The cam 1370 includes a first channel 1378 and a second channel 1379 that are disposed into the cylindrical sidewall 1372. The first and second channels can be axially separated with the first channel proximate the first end face 1372 of the cam and the second channel proximate the second end face 1374, with both channels have a sinusoidal pattern. To engage the channels 1378, 1379, the yoke 1390 has a first follower element 1396 extending inwardly from the first leg 1392 and a second follower element 1398 extending inwardly from the second leg 1394. The first and second follower elements 1396, 1398 are attached at different locations along the lengths of the respective first and second leg 1392, 1394 to correspond to the axially separated first and second channels 1378, 1379. When the cam 1370 rotates, it drives the yoke 1390 via the follower elements 1396, 1398 from a position wherein the reciprocal element 1360 is fully retracted with respect to the chamber 1350 to a position wherein the reciprocal element if fully extended into the chamber 1350.

Figure 23:
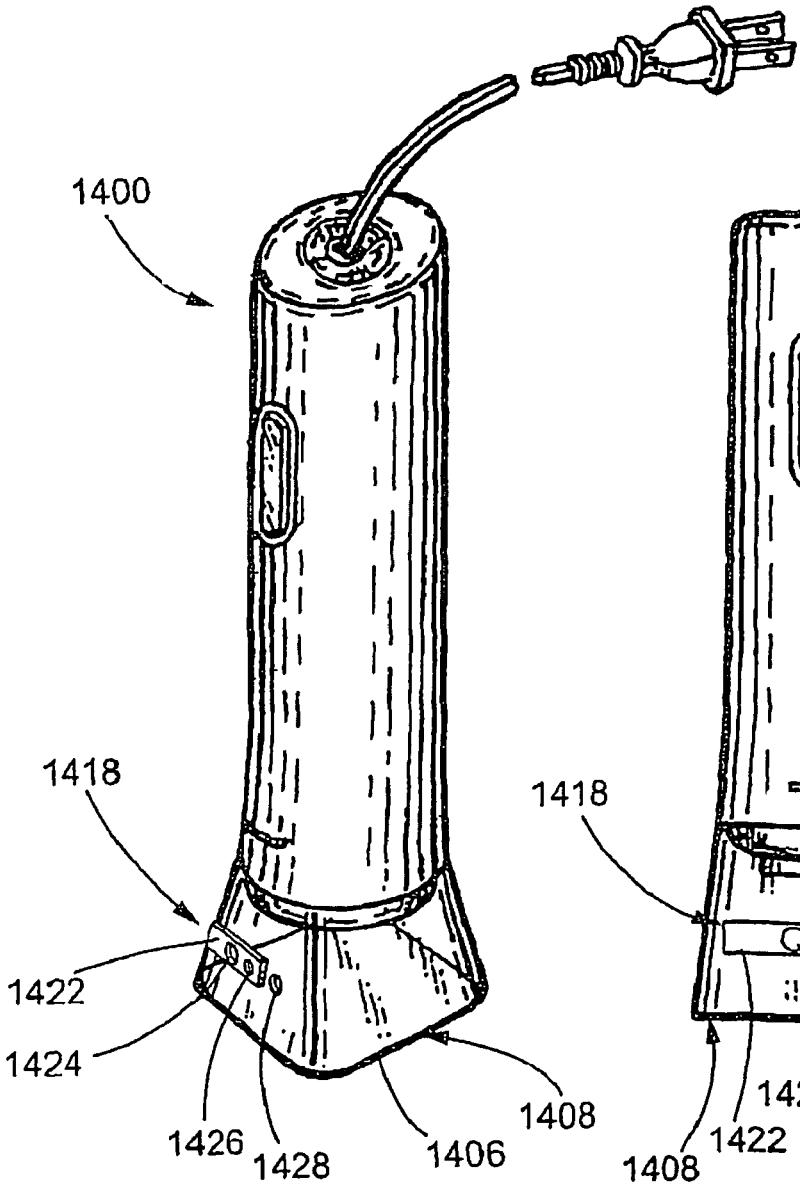
FIG. 23 is a view of another embodiment of a hand held vacuum device having a user selectable pressure control feature including a slide and alignable holes.
Figure 24:
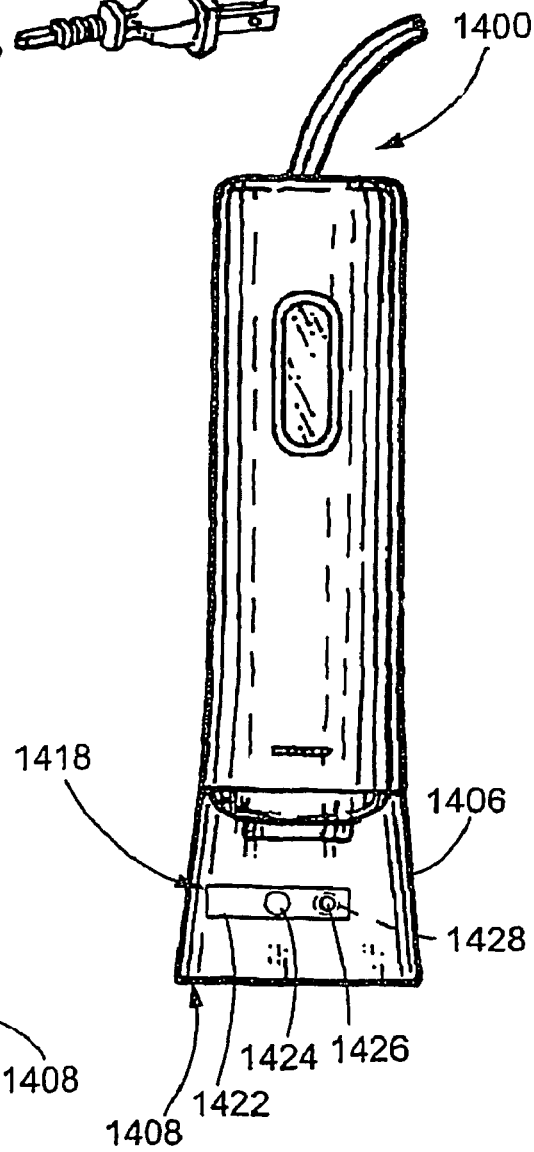
FIG. 24 is a front elevational view of the hand held evacuation device of FIG. 23 showing the pressure control feature in a different position.

Referring to FIGS. 23 and 24, there is illustrated another embodiment of a handheld evacuation device 1400 having a user selectable pressure control feature 1418. In the illustrated embodiment, the nozzle 1406 of the evacuation device tapers at one end to form a generally square inlet opening 1408. The user selectable pressure control feature 1418 operates on the same principle described above but includes a movable slide 1422 connected to and movable with respect to the nozzle 1406. A plurality of varying sized holes 1424 and 1426 are disposed along the length of the slide 1422. Disposed through the nozzle 1406 is an aperture 1428 which may be at least as large as the largest hole 1424 in the slide 1422. The slide 1422 is movable with respect to the nozzle 1406 to align the various holes 1424, 1426 with the aperture 1428 and thereby control evacuation pressure in the manner described above.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventor(s) for carrying out the invention. Variations of those preferred embodiments may become apparent to those of ordinary skill in the art upon reading the foregoing description. The inventor(s) expect skilled artisans to employ such variations as appropriate, and the inventor(s) intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A method of evacuating a storage container having a sidewall enclosing an interior volume and a one-way valve element attached to the sidewall and communicating with the interior volume, the method comprising:

i) providing an evacuation device having a housing including a nozzle having a side aperture, a motor with a rotating shaft extending along an axis line and located in the housing, a reciprocal element operatively connected to the rotated shaft and reciprocally movable along the axis line within a chamber, the chamber being in communication with the nozzle, a rotating ring having one or more ring holes;

ii) aligning a ring hole with the aperture;

iii) placing the nozzle over the valve element;

iv) rotating the motor to move the reciprocal element along the axis line within the chamber during an intake stroke; and v) transferring air from the interior volume to the chamber via the one-way valve element.

2. The method of claim 1, wherein the nozzle includes an indicator and the holes on the rotating ring include indicia corresponding to suitable items for evacuation.

3. The method of claim 1, wherein the operative connection includes a cam and a yoke, the cam mounted on the shaft, the cam having a cylindrical sidewall and a channel disposed into the sidewall, the yoke connected to the reciprocal element and having a follower element received in the channel.

4. The method of claim 3, the nozzle providing an intake volume, the nozzle adapted to engage the sidewall of a container proximate a one-way valve element, the intake volume communicating with the chamber.

5. The method of claim 3, wherein the yoke includes a first arm and a second arm, the cam located between the first and second arms.

6. The method of claim 5, wherein the follower element projects from the first arm.

7. The method of claim 6, wherein the follower element is rotatably connected to the first arm.

8. The method of claim 7, wherein the yoke includes guide wheels on the first and second arms, the guide wheels received in respective first and second guide slots associated with the housing.

9. The method of claim 8, wherein the yoke includes sliders on the first and second arms, the sliders received in respective first and second guide slots associated with the housing.

10. The method of claim 9, wherein the chamber includes an axial face wall and cylindrical sidewall, the axial face wall including an inlet aperture and an outlet aperture and the piston slidably contacting the cylindrical sidewall.

11. The method of claim 10, further comprising a manifold having an inlet channel and an outlet channel, the manifold axially aligned with the axial face wall, the inlet channel in communication with the inlet aperture and the outlet channel in communication with the outlet aperture.

12. The method of claim 11, further comprising a valve plate between the axial face wall and the manifold, the valve plate including an inlet flapper valve for controlling flow between the inlet channel and the inlet aperture, the valve plate further including an outlet flapper valve for controlling flow between the outlet channel and the outlet aperture.

13. The method of claim 12, further comprising a pressure control valve communicating with the chamber, the pressure control valve controlling flow between the chamber and ambient conditions.

14. The method of claim 13, wherein the pressure control valve comprises a spring and disk valve.

* * * * *